US010854155B2

(12) United States Patent
Lee et al.

(10) Patent No.: US 10,854,155 B2
(45) Date of Patent: Dec. 1, 2020

(54) DISPLAY APPARATUS AND METHOD OF DRIVING THE SAME

(71) Applicant: SAMSUNG DISPLAY CO., LTD., Yongin-si (KR)

(72) Inventors: Kyoungwon Lee, Yongin-si (KR); Kwan-young Oh, Yongin-si (KR); Jimyoung Seo, Yongin-si (KR); Bonghyun You, Yongin-si (KR); Junghwan Cho, Yongin-si (KR); Sangsu Han, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/407,324

(22) Filed: May 9, 2019

(65) Prior Publication Data

US 2019/0266967 A1 Aug. 29, 2019

Related U.S. Application Data

(62) Division of application No. 15/446,137, filed on Mar. 1, 2017, now Pat. No. 10,311,812.

(30) Foreign Application Priority Data

Apr. 8, 2016 (KR) ..... 10-2016-0043661

(51) Int. Cl.
*G09G 3/36* (2006.01)
*G09G 3/20* (2006.01)

(52) U.S. Cl.
CPC ..... *G09G 3/3614* (2013.01); *G09G 3/3611* (2013.01); *G09G 3/3677* (2013.01);
(Continued)

(58) Field of Classification Search
CPC .. G09G 3/3614; G09G 3/3611; G09G 3/3677; G09G 3/3688; G09G 3/23;
(Continued)

(56) References Cited

U.S. PATENT DOCUMENTS 8,982,108 B2 3/2015 Lee et al.
9,485,454 B1 11/2016 Liang et al.
2005/0225681 A1* 10/2005 Sohn ..... G09G 3/2022 348/607

(Continued)

FOREIGN PATENT DOCUMENTS

KR 10-2015-0088825 A 8/2015

*Primary Examiner* — Mark Edwards
(74) *Attorney, Agent, or Firm* — Kile Park Reed & Houtteman PLLC

(57) ABSTRACT

A display apparatus includes a display panel, a timing controller, a data driver, and a gate driver. The timing controller receives image data at a number of frames per second of a first level and generates a gate control signal and a data control signal. The timing controller includes an image converter that operates in film mode or normal mode when the input image data are moving image data, and that outputs film image data at a number of frames per second of second level lower than the first level during the film mode. The data driver applies a data voltage corresponding to the film image data to the display panel based on the data control signal. The gate driver applies a gate voltage to the display panel based on the gate control signal. The display panel operates at a frequency of the second level during the film mode.

9 Claims, 22 Drawing Sheets

(52) U.S. Cl.
CPC ..... *G09G 3/3688* (2013.01); *G09G 3/2003* (2013.01); *G09G 2300/0426* (2013.01); *G09G 2310/0251* (2013.01); *G09G 2310/08* (2013.01); *G09G 2320/0261* (2013.01); *G09G 2320/103* (2013.01); *G09G 2330/021* (2013.01); *G09G 2330/023* (2013.01); *G09G 2340/0435* (2013.01); *G09G 2360/16* (2013.01)

(58) Field of Classification Search
CPC ... G09G 2300/0426; G09G 2310/0251; G09G 2310/08; G09G 2320/0261; G09G 2320/103; G09G 2330/021; G09G 2330/023; G09G 2340/0435; G09G 2360/16
See application file for complete search history.

(56) References Cited

U.S. PATENT DOCUMENTS

2007/0273787 A1 11/2007 Ogino et al.
2012/0154553 A1* 6/2012 Zustak ..... H04N 13/167 348/51
2012/0320009 A1 12/2012 Liu
2013/0100261 A1* 4/2013 Kwak ..... G02B 30/24 348/55
2014/0022220 A1 1/2014 Lee et al.
2014/0043315 A1 2/2014 Yamazaki et al.
2014/0146033 A1 5/2014 Koyama et al.
2015/0033047 A1 1/2015 Byun et al.
2015/0145901 A1* 5/2015 Lee ..... G09G 3/3614 345/691
2017/0236497 A1* 8/2017 Huitema ..... G09G 5/393 345/173

* cited by examiner

DISPLAY APPARATUS AND METHOD OF DRIVING THE SAME

CROSS-REFERENCE TO RELATED APPLICATIONS

This is a divisional application based on pending application Ser. No. 15/446,137, filed Mar. 1, 2017, the entire contents of which is hereby incorporated by reference.

Korean Patent Application No. 10-2016-0043661, filed on Apr. 8, 2016, and entitled, "Display Apparatus and Method of Driving the Same," is incorporated by reference herein in its entirety.

BACKGROUND

1. Field

One or more embodiments described herein relate to a display apparatus and a method for driving a display apparatus.

2. Description of the Related Art

A variety of displays have been developed. Examples include liquid crystal displays, organic light emitting displays, and plasma display devices. These displays use a graphic processing unit to generate still and moving images. A still image is displayed when the same image data is output over multiple frames. A moving image is displayed when different image data is output over multiple frames. One goal of display designers is to reduce power consumption both during the display of still images and moving images.

SUMMARY

In accordance with one or more embodiments, a display apparatus includes a display panel to display images; a timing controller to receive input image data at a number of frames per second of a first level and to generate a gate control signal and a data control signal, the timing controller including an image converter to operate in a film mode or a normal mode when the input image data are moving image data and to output film image data at a number of frames per second of second level lower than the first level during the film mode; a data driver to apply a data voltage corresponding to the film image data to the display panel based on the data control signal; and a gate driver to apply a gate voltage to the display panel based on the gate control signal, the display panel to be operated at a frequency of the second level during the film mode.

The input image data may include frame image data groups, each of the frame image data groups including a plurality of frame image data equal to each other, wherein: first frame image data among the frame image data may be equal to each other of each of the frame image data groups corresponding to update image data, other frame image data among the frame image data may be equal each other of each of the frame image data groups corresponding to copy image data, and the timing controller may select one of the film mode or the normal mode based on an interval between frames in which the update image data are input.

The image converter may include a copy image detector to analyze the input image data in a unit of a frame to determine whether the input image data are the update image data or the copy image data and to output an image flag signal; a mode selector to receive the image flag signal, output a film mode signal when the update image data are input every frame equal to or greater than K, and output a normal mode signal when the update image are input every frame less than K, wherein K is a natural number; a film mode controller to receive the film mode signal and to output the film image data; and a normal mode controller to receive the normal mode signal to output normal image data. The film image data may include first copy image data right after the update image data.

The display panel may be charged with a data voltage corresponding to one first copy image data during a plurality of frames set based on a frequency having the first level. The display panel may be a liquid crystal display panel, and the film mode controller may include a film image data generator to receive the film mode signal and to output the film image data; a polarity compensator to receive the film image data to output a first polarity signal to the data driver; and a power controller to receive the film image data to output a first power control signal to the data driver.

The data driver may invert a polarity of the data voltage whenever the data voltage corresponding to the frame image data in the film image data is output based on the first polarity signal during the film mode, and may not invert the polarity when an absolute value of a cumulative polarity is equal to or greater than a predetermined value and the cumulative polarity increases due to the polarity inversion.

The data driver may invert a polarity of the data voltage whenever the data voltage corresponding to the frame image data in the film image data is output based on the first polarity signal during the film mode, and when two or more copy image data in one frame image data group among the frame image data groups, input when an absolute value of a cumulative polarity is equal to or greater than a predetermined value, are consecutive and cumulative polarity increases due to a polarity inversion when the data voltage corresponding to the first copy image data is output, the film image data may include copy image data right after the first copy image data.

The first power control signal may be in a first state during output periods of the film image data, the power control signal may be in a second state during blank periods between the output periods of the film image data, the data driver may receive power during the first state of the first power control signal, and the data driver may not receive power during the second state of the first power control signal.

The normal mode controller may output the normal image data at a number of frames per second of the first level, and the display panel may be operated at a frequency having the first level during the normal mode.

The copy image detector may compare a value derived from four arithmetical operations of one frame image data of two frame image data among the input image data to a value derived from four arithmetical operations of the other frame image data of the two frame image data among the input image data, to determine whether the two consecutive frame image data are equal to each other.

The display panel may include a pixel connected to a gate line and a data line, the pixel including a thin film transistor connected to the gate line and the data line with an oxide semiconductor as a channel layer thereof, a pixel electrode connected to the thin film transistor, and a common electrode facing the pixel electrode.

The image converter may be operated in a stop mode when the input image data are still image data. The mode selector may output the film mode signal when the update image data are input every frame in a range between K and N, and the mode selector may output a stop mode signal when the update image data are not input during M or more frames, where N is a natural number equal to or greater than the K and M is a natural number greater than the N.

The image converter may include a stop mode controller to receive the stop mode signal and to output the still image data at a number of frames per second of a third level less than the second level, and the display panel may be operated at a frequency having the third level during the stop mode.

In accordance with one or more other embodiments, a display apparatus includes a display panel to display images; a timing controller to receive input image data at a number of frames per second of first level lower than about 60 fps and to generate a gate control signal and a data control signal, the timing controller including an image converter to be operated in a film mode or a normal mode when the input image data are moving image data and to output film image data at a number of frames per second of the first level during the film mode; a data driver to apply a data voltage corresponding to the film image data to the display panel based on the data control signal; and a gate driver to apply a gate voltage to the display panel based on the gate control signal, the display panel to be operated at a frequency of the first level during the film mode.

The input image data may include update image data different from each other and blank data between the update image data, and the timing controller may select one of the film mode or the normal mode based on a number of the update image data input during a specific time period.

The image converter may include a mode selector to receive the input image data, output a film mode signal when the number of the update image data input during the specific time period is in a range between F and G inclusive, output a normal mode signal when the number of the update image data input during the specific time period exceeds G, and output a stop mode signal when the number of the update image data input during the specific time period is less than F, where F is a natural number and G is a natural number equal to or greater than F; a film mode controller to receive the film mode signal to output the film image data; a normal mode controller to receive the normal mode signal to output the normal image data; and a stop mode controller to receive the stop mode signal to output still image data.

The normal mode controller may output the normal image data at a number of frames per second of a second level greater than the first level, the stop mode controller may output the stop image data at a number of frames per second of third level less than the second level, the display panel may be operated at a frequency of the second level during the normal mode and is to be operated at a frequency of the third level during the stop mode. The film image data may include the update image data, and the display panel may be charged with the data voltage corresponding to one update image data during a plurality of frames set based on the frequency of the second level.

In accordance with one or more other embodiments, a method of driving a display apparatus includes inputting image data at a number of frames per second of a first level; analyzing the input image data in a unit of frame to determine whether the input image data are update image data or copy image data; and operating a display panel in a film mode in which the display panel is to be operated at a frequency having a second level lower than the first level when the update image data of the input image data satisfy a film mode condition, in which the update image data of the input image data are input every frame equal to or greater than K.

Operating the display panel in the film mode may include outputting film image data including first copy image data right after the update image data at the number of frames of the second level; controlling a polarity inversion to invert a polarity of a data voltage corresponding to the update image data whenever the data voltage corresponding to the update image data is output and not to invert the polarity of the data voltage when an absolute value of a cumulative polarity is greater than a predetermined value and the cumulative polarity increases due to the polarity inversion; and controlling power of a data driver so that power is not provided to the data driver during blank periods between output periods of the film image data.

The method may include operating the display panel in a normal mode in which the display panel is operated at a frequency having the second level when the film mode condition is not satisfied.

The method may include operating the display panel in a stop mode in which the display panel is operated at a frequency having a third level lower than the second level when the film mode condition is not satisfied and a stop mode condition in which the update image data of the input image data are not input during M or more frames is satisfied, the film mode condition may be satisfied when the update image data of the input image data are input every frame in a range between K and N inclusive, where N is a natural number equal to or greater than K and M is a natural number greater than N. The method may include operating the display panel in a normal mode in which the display panel is operated at a frequency having a second level when the stop mode condition is not satisfied.

In accordance with one or more other embodiments, a method of driving a display apparatus includes inputting image data including update image data and blank image data to a timing controller a number of frames per second of a first level lower than about 60 fps; and operating a display panel in a film mode in which the display panel is operated at a frequency having the first level when a number of the update image data of the image data input during a specific time period satisfies the film mode condition where number of the update image data is in a range of between F and G inclusive, F is a natural number and G is a natural number equal to or greater than F.

The method may include operating the display panel in a stop mode in which the display panel is operated at a frequency having a third level lower than the second level when the film mode condition is not satisfied and a stop mode condition in which the number of the update image data of the input image data is less than F is satisfied; and operating the display panel in a normal mode when the stop mode condition is not satisfied so that the display panel is operated at a frequency having a second level higher than the first level.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
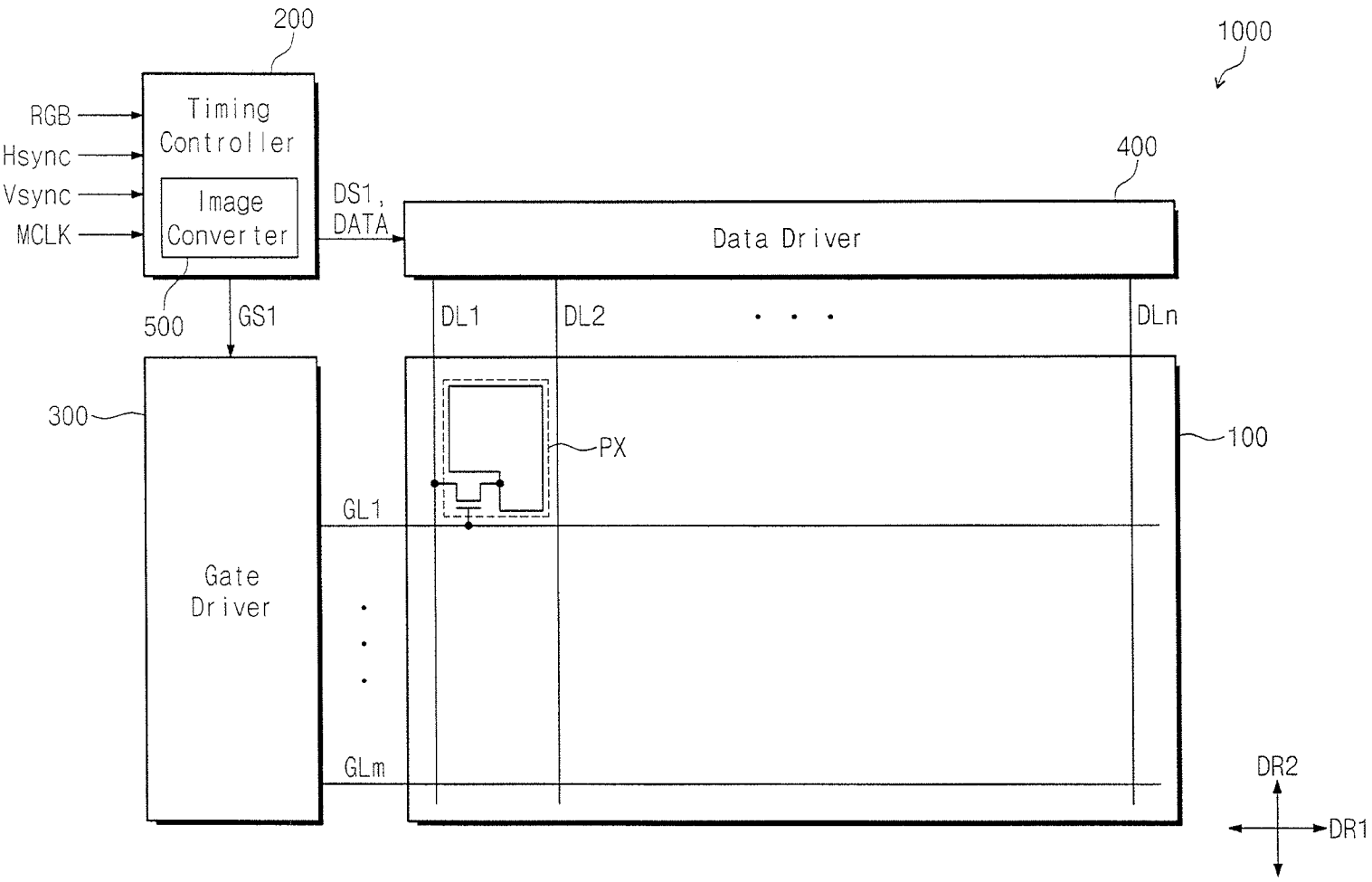
FIG. 1 illustrates an embodiment of a display apparatus.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations. The embodiments (or portions thereof) may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

Figure 2:
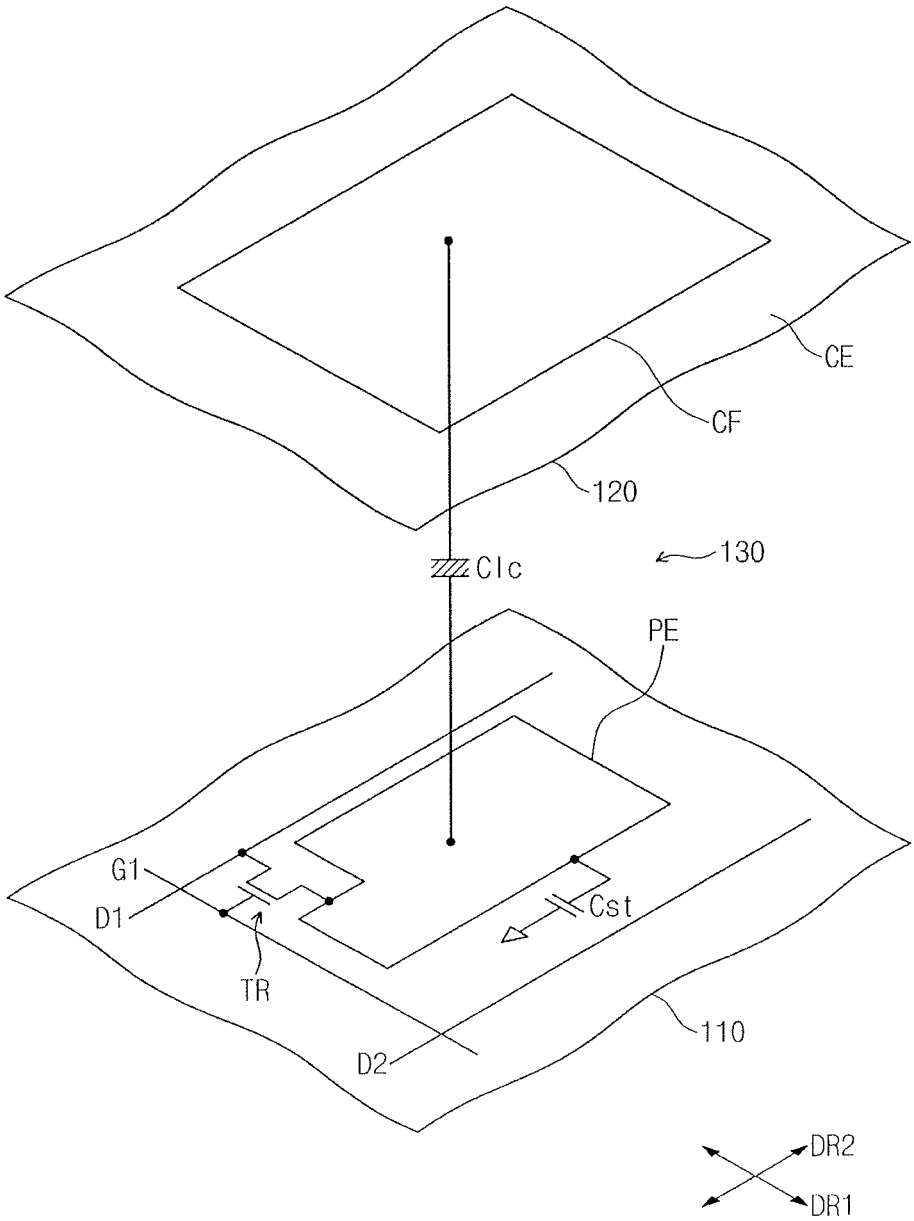
FIG. 2 illustrates an embodiment of a pixel.

FIG. 1 illustrates an embodiment of a display apparatus 1000, and FIG. 2 illustrates an embodiment of pixel in the display apparatus 1000.

Referring to FIG. 1, the display apparatus 1000 includes a display panel 100, a timing controller 200, a gate driver 300, and a data driver 400. The display panel 100 displays images and may be, for example, an organic light emitting display panel, a liquid crystal display panel, a plasma display panel, an electrophoretic display panel, an electrowetting display panel, or another type of display device. For illustrative purposes only, the display panel will be discussed as a liquid crystal display panel.

The display panel 100 includes a liquid crystal layer 130 between a lower substrate 110 and an upper substrate 120, a plurality of gate lines GL1 to GLm extending in a first direction DR1, and a plurality of data lines DL1 to DLn extending in a second direction DR2 crossing the first direction DR1. The gate lines GL1 to GLm and the data lines DL1 to DLn define pixel areas, and a pixel PX is in each pixel area. FIG. 1 shows the pixel PX connected to a first gate line GL1 and a first data line DL1 as a representative example.

The pixel PX includes a thin film transistor TR, a liquid crystal capacitor Clc, and a storage capacitor Cst. The thin film transistor TR is connected to one of the gate lines GL1 to GLm and one of the data lines DL1 to DLn. The liquid crystal capacitor Clc is connected to the thin film transistor TR. The storage capacitor Cst is connected to the liquid crystal capacitor Clc in parallel. In one embodiment, the storage capacitor Cst may be omitted.

The thin film transistor TR is a three-terminal device on the lower substrate 110. The terms may include a control terminal, one terminal, and another terminal. The control terminal is connected to the first gate line GL1, the one terminal is connected to the first data line DL1, and the other terminal is connected to the liquid crystal capacitor Clc and the storage capacitor Cst.

Figure 3:
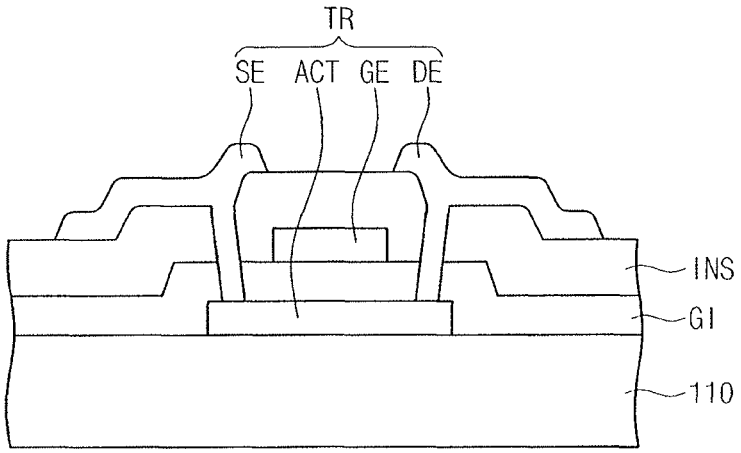
FIG. 3 illustrates an embodiment of a thin film transistor.

FIG. 3 is a cross-sectional view illustrating an embodiment of the thin film transistor TR in FIG. 2. Referring to FIG. 3, the transistor TR includes a semiconductor active layer ACT, a gate electrode GE, a source electrode SE, and a drain electrode DE. The semiconductor active layer ACT is on the lower substrate 110. The gate electrode GE overlaps the semiconductor active layer ACT. A gate insulating layer GI is between the gate electrode GE and the semiconductor active layer ACT. The source electrode SE and the drain electrode DE contact the semiconductor active layer ACT. The source electrode SE and the drain electrode DE are spaced apart from each other. An insulating layer INS is between the source electrode SE and the gate electrode GE and between the drain electrode DE and the gate electrode GE.

The semiconductor active layer ACT includes an oxide semiconductor. The oxide semiconductor includes, for example, at least one of Zn, In, Ga, Sn, or a combination thereof. For instance, the oxide semiconductor may include indium-gallium-zinc oxide (IGZO). In FIG. 3, the gate electrode GE is on the semiconductor active layer ACT. In another embodiment, the gate electrode GE may be under the semiconductor active layer ACT.

The leakage current of a thin film transistor using an oxide semiconductor as its channel layer may be less than the leakage current of a thin film transistor using amorphous silicon or polysilicon as its channel layer. Accordingly, a voltage charged in the liquid crystal capacitor Clc of the pixel including the thin film transistor TR using an oxide semiconductor as the channel layer may be maintained longer than when amorphous silicon or polysilicon is used as the channel layer.

Referring again to FIGS. 1 and 2, the liquid crystal capacitor Clc includes a pixel electrode PE on the lower substrate 110 and a common electrode CE on the upper substrate 120 as its two terminals. The liquid crystal layer 130 between the two electrodes PE and CE serves as a dielectric material. The pixel electrode PE is connected to the thin film transistor TR, and the common electrode CE is formed on an entire surface of the upper substrate 120 to receive a common voltage. In another embodiment, the common electrode CE may be on the lower substrate 110. In this case, at least one of the two electrodes PE and CE may include a slit.

The storage capacitor Cst assists the liquid crystal capacitor Clc and includes the pixel electrode PE, a storage line, and an insulating material between the pixel electrode PE and the storage line. The storage line is on the lower substrate 110 and overlaps a portion of the pixel electrode PE. The storage line is applied with a constant voltage as the storage voltage.

The pixel PX may display one of a plurality of colors, e.g., red, green, blue, and white colors. In another embodiment, the colors may include yellow, cyan, and magenta. The pixel PX may include a color filter CF corresponding to one of the colors. In FIG. 2, the color filter CF is on the upper substrate 120, but may be on the lower substrate 110 in another embodiment.

The timing controller 200 receives input image data RGB and control signals from an external graphic controller. The control signals may include, for example, a vertical synchronization signal Vsync as a frame distinction signal, a horizontal synchronization signal Hsync as a row distinction signal, and/or a main clock signal MCLK.

The timing controller 200 includes an image converter 500 which determines an operation mode based on the input image data RGB and applies input image data DATA converted by the operation mode to the data driver 400. The timing controller 200 generates a gate control signal GS1 and a data control signal DS1 and applies the gate control signal GS1 to the gate driver 300 and the data control signal DS1 to the data driver 400. The gate control signal GS1 drives the gate driver 300, and the data control signal DS1 drives the data driver 400.

The gate driver 300 generates gate signals based on the gate control signal GS1 and applies the gate signals to the gate lines GL1 to GLm. The gate control signal GS1 includes a scan start signal indicating the start of scanning of the gate lines GL1 to GLm, at least one clock signal controlling an output timing of a gate-on voltage, and an output enable signal restricting duration of the gate-on voltage.

The data driver 400 generates grayscale voltages in accordance with the input image data DATA converted based on the data control signal DS1 and applies the grayscale voltages to the data lines DL1 to DLn. The data voltages include a positive data voltage having a positive value with respect to the common voltage and a negative data voltage having a negative value with respect to the common voltage. The data control signal DS1 includes a horizontal start signal indicating the start of transmission of the converted input image data DATA to the data driver 400, a load signal instructing to apply the grayscale voltages to the data lines DL1 to DLn, and an inverting signal inverting the polarity of data voltages relative to the common voltage.

The polarity of the data voltage applied to the pixel PX is inverted at every at least one frame to prevent liquid crystal from burning or deteriorating. For example, the polarity of the data voltage is inverted at every at least one frame in response to the polarity signal applied to the data driver 400.

Each of the timing controller 200, the gate driver 300, and the data driver 400 may be directly mounted on the display panel 100 in the form of at least one integrated circuit chip, attached to the display panel 100 in a tape carrier package (TCP) form after being mounted on a flexible printed circuit board, or mounted on a separate printed circuit board. At least one of the gate driver 300 and the data driver 400 may be integrated on the display panel 100 together with the gate lines GL1 to GLm, the data lines DL1 to DLn, and the thin film transistor TR. The timing controller 200, the gate driver 300, and the data driver 400 may be integrated in a single chip.

Figure 4:
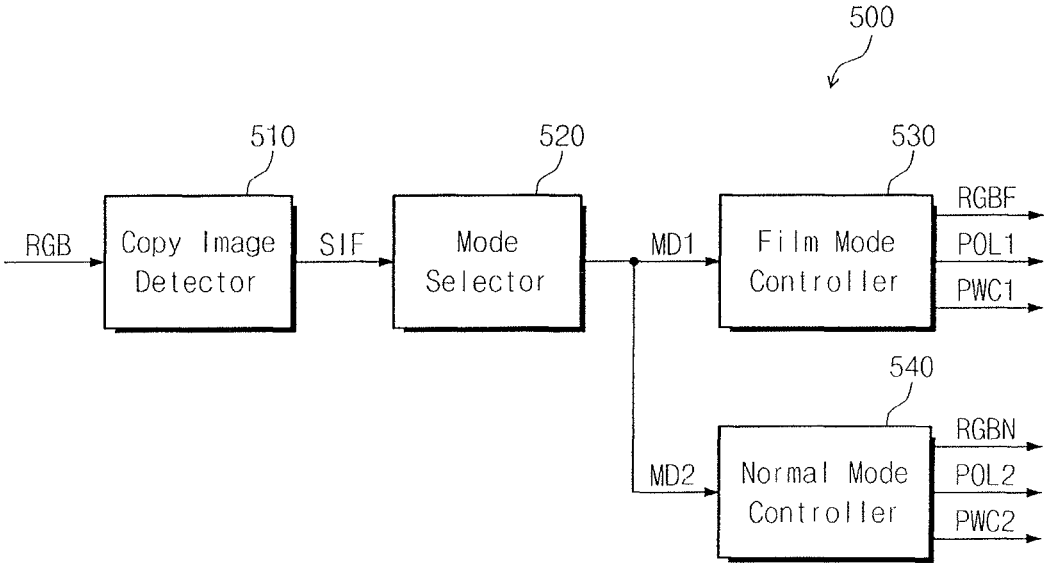
FIG. 4 illustrates an embodiment of an image converter.

FIG. 4 illustrates an embodiment of the image converter 500 which includes a copy image detector 510, a mode selector 520, a film mode controller 530, and a normal mode controller 540.

The copy image detector 510 receives input image data RGB which includes frame image data consecutively input. Among the frame image data, first frame image data may be referred to as update image data and the rest of the frame image data may be referred to as copy image data.

The copy image detector 510 analyzes the input image data RGB to determine whether the input image data RGB are the update image data or the copy image data in the unit of a frame and outputs the analyzed result as an image flag signal SIF.

The input image data RGB may be still image data or moving image data. In the case that the input image data RGB are moving image data, the input image data RGB may include the same frame image data consecutively input. For instance, the input image data RGB may include two or three consecutive same frame image data. The input image data RGB may include update image data and copy image data copied from the update image data, to allow the input image data RGB to be output from the external graphic controller, for example, at 60 fps.

The mode selector 520 receives the image flag signal SIF and determines whether the mode selector 520 is operated in film mode. The mode selector 520 may select either the film mode or the normal mode. The mode selector 520 outputs a film mode signal MD1 to select the film mode or a normal mode signal MD2 to select the normal mode.

The mode selector 520 determines whether to output the film mode signal MD1 or the normal mode signal MD2 based on an interval between frames in which the update image data are input. For example, when the update image data of the input image data RGB are input at every frame that is equal to or greater than K, the mode selector 520 outputs the film mode signal MD1. In the case that the update image data of the input image data RGB are input at every frame that is equal to or smaller than K, the mode selector 520 outputs the normal mode signal MD2. In the present exemplary embodiment, K is 2 but may be another number is a different embodiment.

When the film mode controller 530 receives the film mode signal MD1, the image converter 500 is operated in film mode. When the normal mode controller 540 receives the normal mode signal MD2, the image converter 500 is operated in normal mode. The film mode controller 530 receives the film mode signal MD1 and outputs film image data RGBF, a first polarity signal POL1, and a first power control signal PWC1. The normal mode controller 540 receives the normal mode signal MD2 and outputs normal image data RGBN, a second polarity signal POL2, and a second power control signal PWC2.

Figure 5:
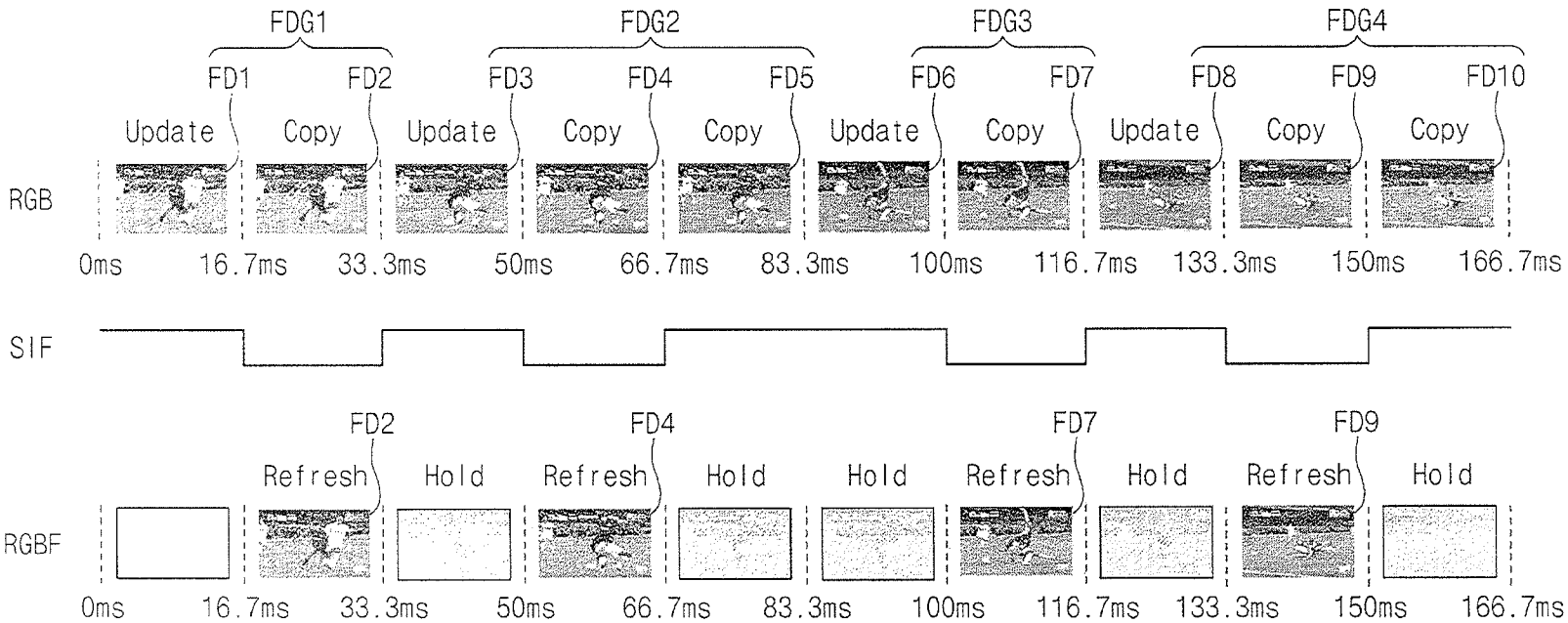
FIG. 5 illustrates an embodiment of an image flag signal and film image data.

FIG. 5 illustrates an image flag signal and film image data generated based on input image data. In particular, FIG. 5 illustrates input image data RGB including ten consecutive frame image data FD1 to FD10. Among the frame image data, first and second frame image data FD1 and FD2 are the same as each other, third to fifth frame image data FD3 to FD5 are the same as each other, sixth and seventh frame image data FD6 and FD7 are the same as each other, and eighth to tenth frame image data FD8 to FD10 are the same as each other.

The frame image data that are same as each other may be referred to as frame image data groups. FIG. 5 illustrates first to fourth frame image data groups FDG1 to FDG4. The first frame image data group FDG1 includes the first and second frame image data FD1 and FD2. The second frame image data group FDG2 includes the third, fourth, and fifth frame image data FD3, FD4, and FD5. The third frame image data group FDG3 includes the sixth and seventh frame image data FD6 and FD7. The fourth frame image data group FDG4 includes the eighth, ninth, and tenth frame image data FD8, FD9, and FD10.

Referring to FIGS. 4 and 5, the copy image detector 510 analyzes the frame image data FD1 to FD10 to set each of the frame image data FD1 to FD10 to one of the update image data or the copy image data.

The copy image detector 510 analyzes the two consecutive two frame image data to determine whether the two consecutive two frame image data are the same as each other. The copy image detector 510 compares a value derived from four arithmetical operations of grayscales of one frame image data of the two frame image data with a value derived from four arithmetical operations of grayscales of the other frame image data of the two frame image data. For instance, the copy image detector 510 may compare the value derived from four arithmetical operations of grayscales of the first frame image data FD1 with the value derived from four arithmetical operations of grayscales of the second frame image data FD2 to determine whether the first frame image data FD1 are the same as the second frame image data FD2. The value derived from four arithmetical operations may be determined by calculating all pixel data in one frame data according to a predetermined method.

Among the frame image data that are the same as each other, first frame image data are the update image data and the other frame data are the copy image data. For instance, the first frame image FD1 are the update image data and the second frame image data FD2 are the copy image data. Similarly, the third frame image data FD3 are the update image data and each of the fourth and fifth frame image data FD4 and FD5 are the copy image data.

When present frame image data correspond to frame image data input first or are different from previous frame image data, the copy image detector 510 determines the present frame image data to be the update image data. In addition, when the present frame image data are the same as the previous frame image data, the copy image detector 510 determines the present frame image data to be the copy image data.

Since the first frame image data FD1 are the firstly-input frame image data, the first frame image data FD1 may be the update image data. Since the second frame image data FD2 are the same as the first frame image data FD1, the second frame image data FD2 may be the copy image data. Since the third frame image data FD3 are different from the second frame image data FD2, the third frame image data FD3 may be the update image data.

The input image data RGB in FIG. 5 include two or three consecutive same frame data that are repeated. Thus, the mode selector 520 may output the film mode signal MD1 when the input image data RGB in FIG. 5 are applied thereto.

The input image data RGB may be input at the number of frames per second at a high level. In FIG. 5, the high level is about 60. Thus, the update image data and the copy image data of the input image data RGB are input about sixty-times every second, e.g., at 60 fps.

The image flag signal SIF may have different states during a period in which the update image data are applied and a period in which the copy image data are applied. As a first example, the image flag signal SIF has a high state during the period in which the update image data are applied and has a low stage during the period in which the copy image data are applied. As a second example demonstrated by FIG. 5, the image flag signal SIF has a low state for the next frame period after the update image data are applied and has a high state for the next frame period after the copy image data are applied.

Figure 6:
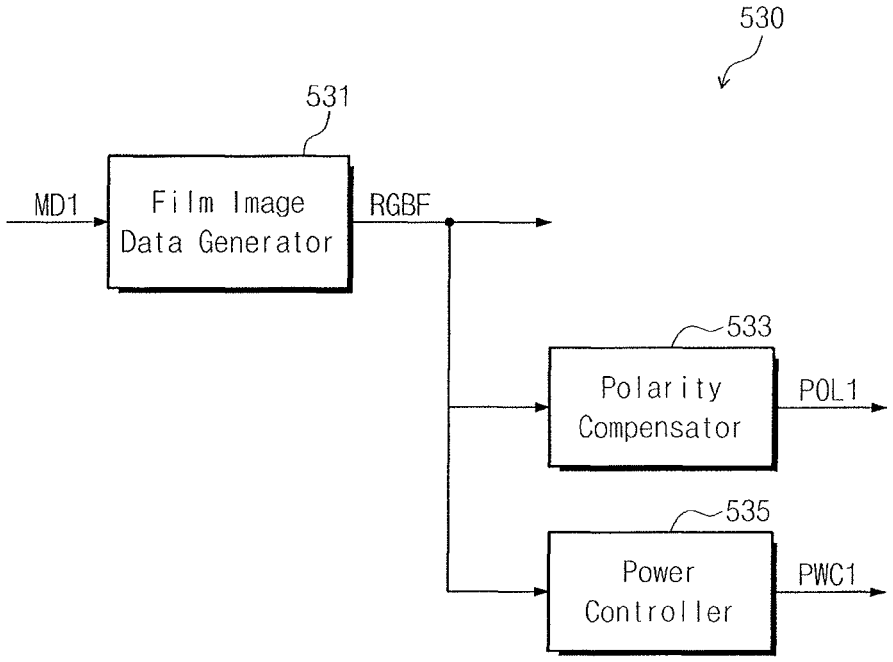
FIG. 6 illustrates an embodiment of a film mode controller.

FIG. 6 illustrates an embodiment of the film mode controller 530 in FIG. 4.

Referring to FIGS. 4 to 6, the film mode controller 530 includes a film image data generator 531, a polarity compensator 533, and a power controller 535. The film image data generator 531 receives the film mode signal MD1 and outputs the film image data RGBF. The film image data RGBF may include the copy image data (first copy image data) right after the update image data. In the present exemplary embodiment, the film image data RGBF include the first copy image data, but do not include the copy image data after second copy image data.

The film image data RGBF in FIG. 5 include the second frame image data FD2, the fourth frame image data FD4, the seventh frame image data FD7, and the ninth frame image data FD9. For instance, since the second frame image data FD2 are the copy image data right after the first frame image data FD1, the film image data RGBF may include the second frame image data FD2. Since the fourth frame image data FD4 are the copy image data right after the third frame image data FD3, the film image data RGBF may include the fourth frame image data FD4. Since the fifth frame image data FD5 are not the copy image data right after the third frame image data FD3, the film image data RGBF do not include the fifth frame image data FD5.

The film image data RGBF may be output at the number of frames per second of a middle level less than the high level. In FIG. 5, the middle level is about 24. That is, the copy image data of the film image data RGBF are output about twenty four-times every second, e.g., at 24 fps.

The display panel 100 (e.g., refer to FIG. 1) outputs the image corresponding to the film image data RGBF during the film mode. The display panel 100 may be operated at a frequency corresponding to the middle level. The display panel 100 may be charged with the data voltage corresponding to one first copy image data during a plurality frames set with respect to the frequency of the high level. In FIG. 5, the frame is set based on 60 Hz and one frame is maintained during about 16.7 ms. In this case, the display panel 100 may be refreshed to display an image corresponding to the second frame image data FD2 during a second frame (about 16.7 ms to 33.3 ms) set based on 60 Hz. The image corresponding to the second frame image data FD2 is maintained during the third frame (about 33.3 ms to about 50 ms).

The display panel 100 is refreshed to display an image corresponding to the fourth frame image data FD4 during a fourth frame (about 50 ms to about 66.7 ms). The image corresponding to the fourth frame image data FD4 is maintained during the fifth and sixth frame (about 66.7 ms to about 100 ms).

The display panel 100 is refreshed to display an image corresponding to the seventh frame image data FD7 during a seventh frame (about 100 ms to about 116.7 ms). The image corresponding to the seventh frame image data FD7 is maintained during the eighth frame (about 116.7 ms to about 133.3 ms).

The display panel 100 is refreshed to display an image corresponding to the ninth frame image data FD9 during a ninth frame (about 133.3 ms to about 150 ms). The image corresponding to the ninth frame image data FD9 is maintained during the tenth frame (about 150 ms to about 166.7 ms).

The display panel 100 is refreshed four times during ten frames set based on 60 Hz, and thus the display panel 100 may be understood as being operated at about 24 Hz.

Figure 7:
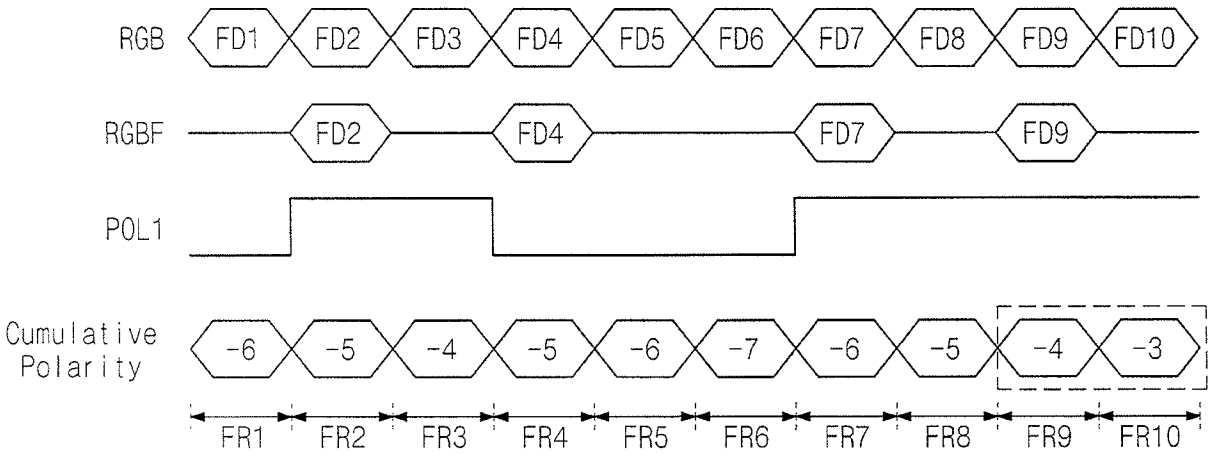
FIG. 7 illustrates an embodiment of input image data, film image data, and a polarity signal.

FIG. 7 is a timing diagram illustrating an embodiment of input image data, film image data, and a first polarity signal. Referring to FIGS. 5 to 7, the polarity compensator 533 receives the film image data RGBF and outputs the first polarity signal POLL The first polarity signal POL1 is applied to the data driver 400.

The data driver 400 (refer to FIG. 1) inverts a polarity of the data voltage in response to the first polarity signal POL1 during the film mode. Responsive to the first polarity signal POL1, the data driver 400 inverts the polarity of the data voltage whenever the data voltage corresponding to the frame image data in the film image data are output during the film mode. When the absolute value of a cumulative polarity of the data voltage is greater than a predetermined value and the cumulative polarity increases by the polarity inversion, the data driver may not invert the polarity of the data voltage.

FIG. 7 shows the cumulative polarity of each of the frames FR1 to FR10. In addition, a reference value of the cumulative polarity, which is a reference of the polarity inversion, is about 5.

In the description associated with FIG. 7, the data driver will be described on the assumption that when the first polarity signal POL1 is in high state, the data driver 400 outputs the data voltage having a positive polarity, and when the first polarity signal POL1 is in low state, the data driver 400 outputs the data voltage having a negative polarity. However, the data voltage corresponding to one frame image data may be divided into the positive-polarity voltage and the negative-polarity voltage.

The absolute value of the cumulative polarity may be −6 before the second frame image data FD2 of the film image data RGBF are input. A cumulative polarity of −6 means that the negative-polarity data voltage is six times greater output than the positive-polarity data voltage. The absolute value of the cumulative polarity right after the first frame FR1 is 6.

The first polarity signal POL1 transitions from the low state to the high state in synchronization with a time point at which the second frame image data FD2 are applied. The first polarity signal POL1 is maintained in the high state until the fourth frame image data FD4 are input. The absolute value of the cumulative polarity is reduced to 4 during the second and third frames FR2 and FR3 during which the data voltage corresponding to the second frame image data FD2 is applied to the display panel 100.

Since the absolute value of the cumulative polarity right after the third frame FR3 is less than 5, the first polarity signal POL1 transitions from the high state to the low state in synchronization with a time point at which the fourth frame image data FD4 are applied. The polarity of the data voltage corresponding to the second frame image data FD2 may be different from the polarity of the data voltage corresponding to the fourth frame image data FD4. The first polarity signal POL1 is maintained in the low state from a time point at which the fourth frame image data FD4 are applied to a time point at which the seventh frame image data FD7 are input. The absolute value of the cumulative polarity increases to 7 during the fourth to sixth frames FR4 to FR6 during which the data voltage corresponding to the fourth frame image data FD4 is applied to the display panel 100.

The absolute value of the cumulative polarity right after the sixth frame FR6 is equal to or greater than 5, but the cumulative polarity is reduced due to the polarity inversion of the data voltage corresponding to the seventh frame image data FD7. Accordingly, the first polarity signal POL1 transitions from the low state to the high state at a time point at which the seventh frame image data FD7 are applied. The polarity of the data voltage corresponding to the fourth frame image data FD4 may be different from the polarity of the data voltage corresponding to the seventh frame image data FD7. The first polarity signal POL1 is maintained in the high state from a time point at which the seventh frame image data FD7 are applied to a time point at which the ninth frame image data FD9 are input. The absolute value of the cumulative polarity is reduced to 5 during the seventh and eighth frames FR7 to FR8 during which the data voltage corresponding to the seventh frame image data FD7 is applied to the display panel 100.

The absolute value of the cumulative polarity right after the eighth frame FR8 is equal to or greater than 5, and the cumulative polarity increases due to the polarity inversion of the data voltage corresponding to the ninth frame image data FD9. Accordingly, the polarity of the first polarity signal POL1 is not inverted at the time point at which the ninth frame image data FD9 are applied and is maintained in the high state. The polarity of the data voltage corresponding to the seventh frame image data FD7 may be the same as the polarity of the data voltage corresponding to the eighth frame image data FD8. The first polarity signal POL1 is maintained in the high state from the time point at which the ninth frame image data FD9 are applied to a time point at which next frame image data are applied. The absolute value of the cumulative polarity is reduced to 3 during the ninth and tenth frames FR9 to FR10 during which the data voltage corresponding to the ninth frame image data FD9 is applied to the display panel 100.

In accordance with the present exemplary embodiment, the polarity imbalance may be prevented from increasing more than a predetermined value when the display apparatus 1000 is operated in the film mode.

Figure 8:
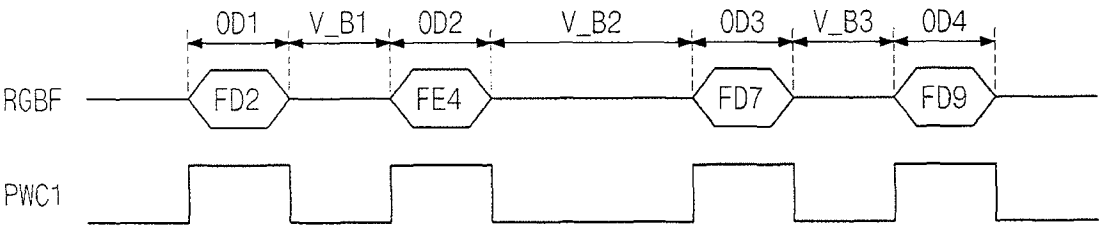
FIG. 8 illustrates an embodiment of film image data and a power control signal.

FIG. 8 is a timing diagram illustrating an embodiment of film image data and a first power control signal. Referring to FIGS. 5, 6, and 8, the power controller 535 receives the film image data RGBF and outputs the first power control signal PWC1. The first power control signal PWC1 is provided to the data driver 400.

During the film mode, the data driver 400 (e.g., refer to FIG. 1) may control a standby power in response to the first power control signal PWC1. For example, the data driver 400 receives the power during a high period of the first power control signal PWC1 and does not receive the power during a low period of the first power control signal PWC1. A bias voltage may not be applied to an amplifier in the data driver 400 during the low period of the first power control signal PWC1.

The second frame image data FD2, the fourth frame image data FD4, the seventh frame image data FD7, and the ninth frame image data FD9 are output during first, second, third, and fourth output periods OD1, OD2, OD3, and OD4, respectively.

A vertical blank period may be defined between the output periods of the frame image data of the film image data RGBF. A first vertical blank period V_B1 is defined between the first and second output periods OD1 and OD2, a second vertical blank period V_B2 is defined between the second and third output periods OD2 and OD3, and a third vertical blank period V_B3 is defined between the third and fourth output periods OD3 and OD4.

The first power control signal PWC1 is in high state during the first to fourth output periods OD1 to OD4 and is in low state during the first to third vertical blank periods V_B1 to V_B3.

The display apparatus 1000 may further include a voltage generator that generates voltages for operations of the display panel 100, the timing controller 200, the gate driver 300, and the data driver 400. The first power control signal PWC1 may be applied to the voltage generator. The voltage generator may control the standby power in response to the first power control signal PWC1 during the film mode.

For example, the level of the bias voltage applied to the amplifier in the voltage generator during the low period of the first power control signal PWC1 may be lower than a level of the bias voltage applied to the amplifier in the voltage generator during the high period of the first power control signal PWC1. Thus, the slew rate of the voltage generated by the voltage generator during the low period of the first power control signal PWC1 may be less than the slew rate of the voltage generated by the voltage generator during the high period of the first power control signal PWC1.

Figure 9:
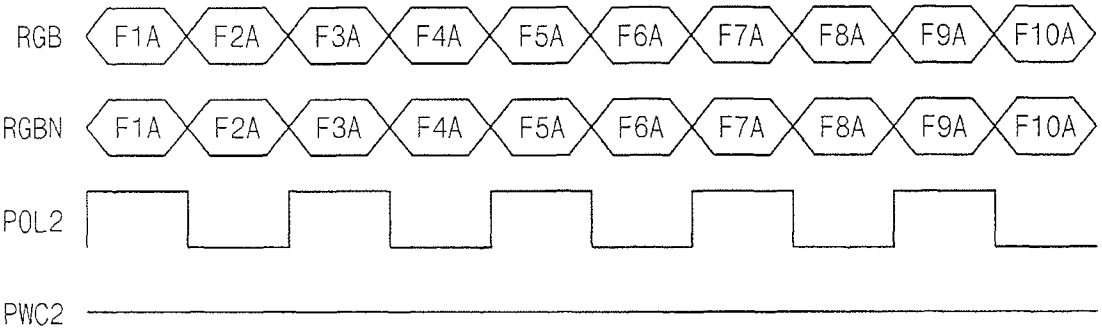
FIG. 9 illustrates an embodiment of input image data, normal image data, another polarity signal, and another power control signal.

FIG. 9 is a timing diagram illustrating input image data, normal image data, a second polarity signal, and a second power control signal, which are input to or output from the normal mode controller 540.

Referring to FIGS. 4 and 9, the normal mode controller 540 receives the normal mode signal MD and applies normal image data RGBN, the second polarity signal POL2, and the second power control signal PWC2 to the data driver 400. In FIG. 9, frame image data F1A to F10A of the input image data RGB may have different image information from each other. In other words, each of the frame image data F1A to F10A of the input image data RGB may be the update image data.

The mode selector 520 outputs the normal mode signal MD2 when the input image data in FIG. 9 are applied thereto. The normal image data RGBN may be substantially the same as the input image data RGB. The normal image data RGBN may include the first to tenth frame image data F1A to F10A. The normal image data RGBN may be output at the number of frames per second of high level, which is the same as the input image data RGB. In the present exemplary embodiment, the high level may be 60. The normal image data RGBN may be output at about 60 fps.

The display panel 100 (e.g., refer to FIG. 1) displays an image corresponding to the normal image data RGBN during the normal mode. The display panel 100 is operated at a high level frequency.

During the normal mode, the data driver 400 (e.g., refer to FIG. 1) inverts the polarity of the data voltage in response to the second polarity signal POL2. Responsive to the second polarity signal POL2, the data driver 400 inverts the polarity of the data voltage whenever the data voltage corresponding to the frame image data are output during the normal mode. The polarity of the data voltage applied to the display panel 100 may be inverted every frame by the second polarity signal POL2.

During the normal mode, the data driver 400 (e.g., refer to FIG. 1) controls the standby power in response to the second power control signal PWC2. The second power control signal PWC2 may have the high state during all periods. Accordingly, the data driver 400 continuously receives the power during the normal mode.

Figure 10:
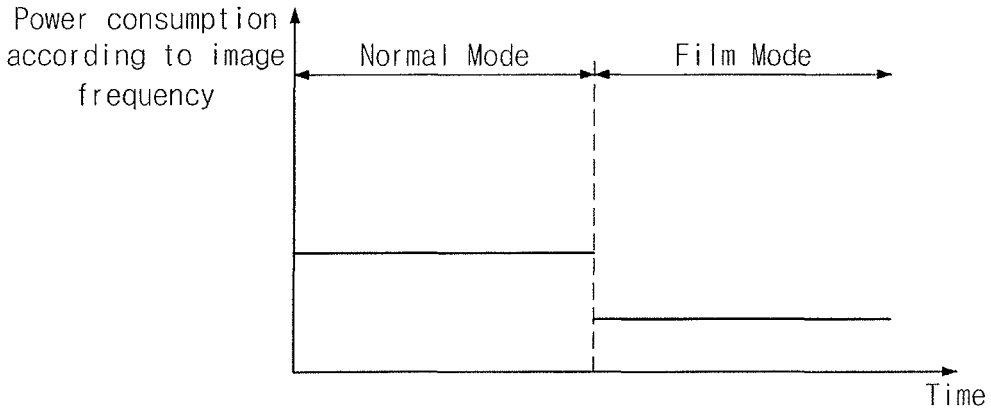
FIG. 10 illustrates an example of power consumption based on image frequency.

FIG. 10 illustrates an example of power consumption according to an image frequency. Referring to FIGS. 4 and 10, the image converter 500 outputs the normal image data RGBN at the number of frames per second of high level during the normal mode and outputs the film image data RGBF at the number of frames per second of a middle level less than the high level during the film mode.

In the display apparatus 1000 according to the present exemplary embodiment, the driving frequency of the display panel 100 during film mode is less than that of the display panel 100 during normal mode. Accordingly, the power consumption according to the image frequency during the film mode is less than the power consumption according to the image frequency during normal mode. The display apparatus 1000 according to the present exemplary embodiment is operated in film mode with a frequency less than that of the normal mode when the input image data RGB satisfy a specific condition. Thus, power consumption may be improved.

Figure 11:
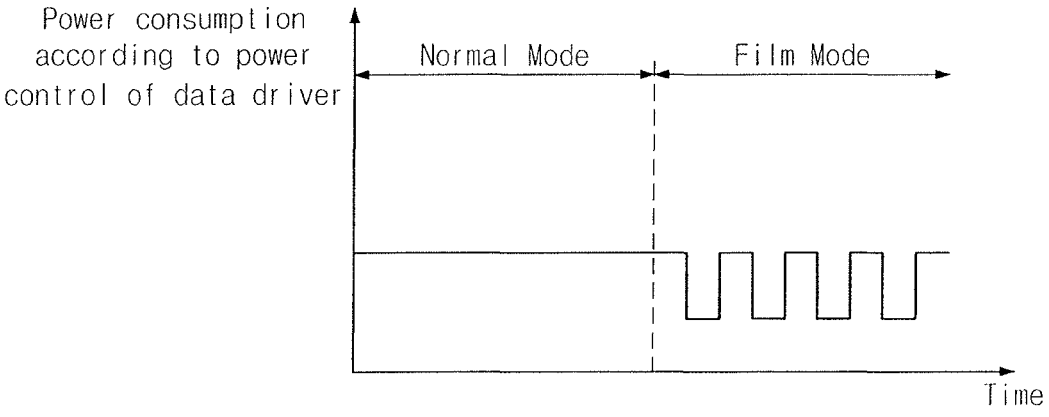
FIG. 11 illustrates an example of a power consumption based on power control of a data driver.

FIG. 11 illustrates an example of power consumption according to a power control of a data driver. Referring to FIGS. 4 and 11, the image converter 500 outputs the second power control signal PWC2 in a high state during normal mode and outputs the first power control signal PWC1 alternately and repeatedly in the high and low states during film mode. The display apparatus 1000 according to the present exemplary embodiment is operated in film mode, in which the standby power of the data driver 400 is less than that of the normal mode, when the input image data RGB satisfy a specific condition. Thus, the power consumption may be improved.

Figure 12:
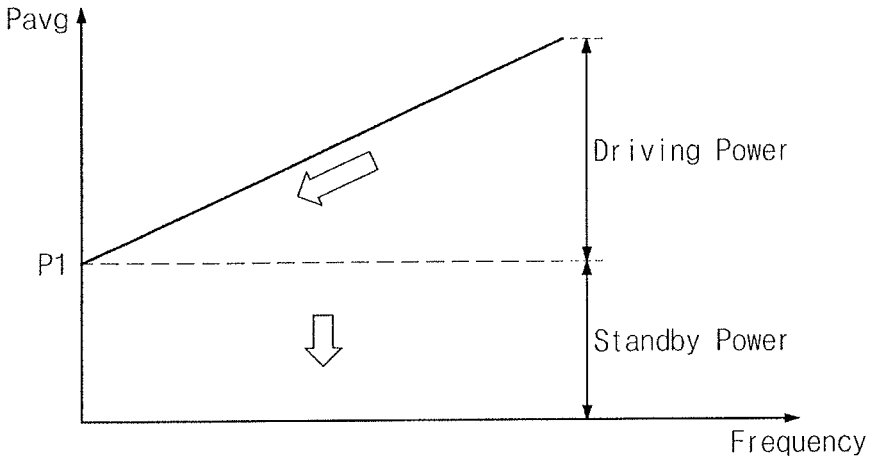
FIG. 12 illustrates an example of power consumption as a function of frequency.

FIG. 12 illustrates an example of power consumption of a display device as a function of a frequency. Referring to FIGS. 10 to 12, the power consumption Pavg of the display apparatus 1000 is divided into the standby power P1 of the data driver 400 and the driving power of the display panel 100. According to the display apparatus 1000 of the present exemplary embodiment, when the input image data RGB satisfy the specific condition, the display apparatus 1000 is operated in film mode to reduce the standby power P1. In addition, when the input image data RGB satisfy the specific condition, the display apparatus 1000 is operated in film mode that lowers the driving frequency of the display panel 100. Thus, the driving power may be reduced.

Figure 13:
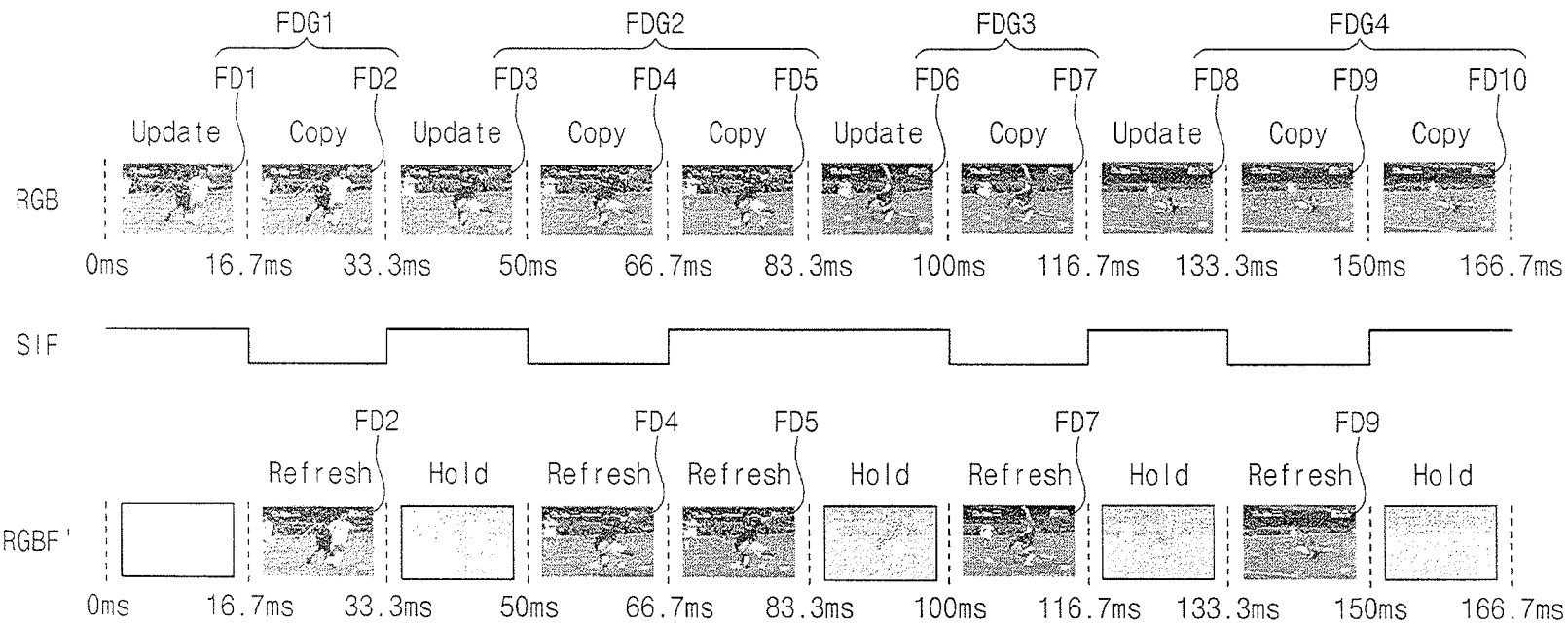
FIG. 13 illustrates an embodiment of an image flag signal and film image data.
Figure 14:
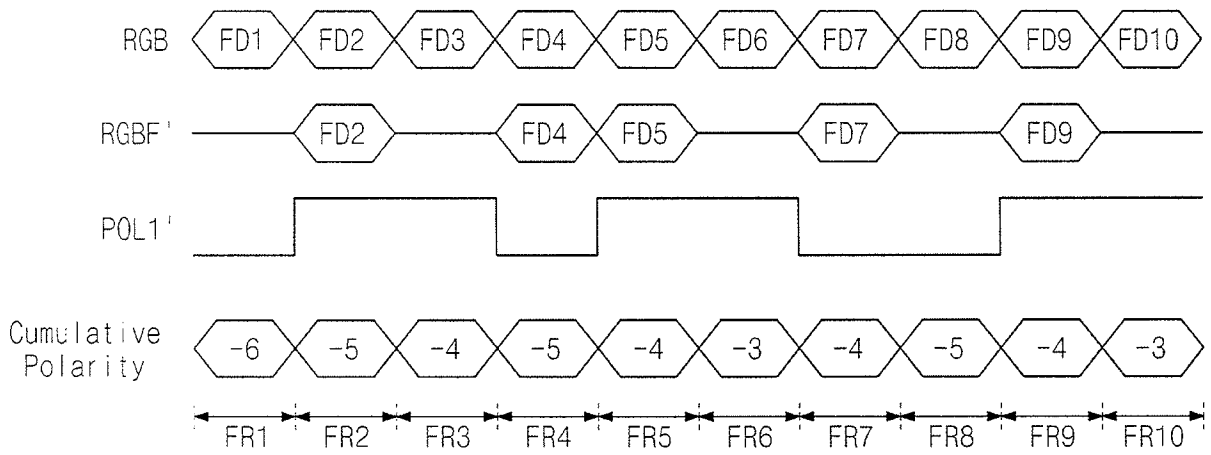
FIG. 14 illustrates another embodiment of input image data, film image data, and a polarity signal.

FIG. 13 illustrates another embodiment of an image flag signal and film image data generated based on input image data. FIG. 14 is a timing diagram illustrating another embodiment of input image data, film image data, and a first polarity signal.

Referring to FIGS. 5, 6, 13, and 14, the polarity compensator 533 receives film image data RGBF and outputs a first polarity signal POL1'. The first polarity signal POL1' is applied to the data driver 400.

During the film mode, the data driver 400 (e.g., refer to FIG. 1) inverts the polarity of the data voltage in response to the first polarity signal POL1'. Responsive to the first polarity signal POL1', the data driver 400 inverts the polarity of the data voltage whenever the data voltage corresponding to the frame image data in the film image data RGBF are output during the film mode. When two or more copy image data in one frame image data group, among frame image data groups input when the absolute value of the cumulative polarity is equal to or greater than a predetermined value, are consecutive and the cumulative polarity increases due to the polarity inversion when the data voltage corresponding to the first copy image data is output, the film image data RGBF may include next copy image data right after the first copy image data.

FIG. 14 illustrates an example of the cumulative polarity of each of the frames FR1 to FR10. In addition, a reference value of the cumulative polarity, which is a reference of the polarity inversion, is about 5.

In connection with FIG. 7, the data driver will be described based on the assumption that the data driver 400 outputs the data voltage having a positive polarity when the first polarity signal POL1' is in a high state. When the first polarity signal POL1 is in a low state, the data driver 400 outputs the data voltage having a negative polarity. However, the data voltage corresponding to one frame image data may be divided into the positive-polarity voltage and the negative-polarity voltage.

The absolute value of the cumulative polarity of −6 is assumed before the second frame image data FD2 of the film image data RGBF are input. The assumption that the cumulative polarity is −6 means that the negative-polarity data voltage is six times greater output than the positive-polarity data voltage. The absolute value of the cumulative polarity right after the first frame FR1 is 6.

The first polarity signal POL1' transitions from the low state to the high state in synchronization with a time point at which the second frame image data FD2 are applied. The first polarity signal POL1 is maintained in the high state until the fourth frame image data FD4 are input. The absolute value of the cumulative polarity is reduced to 4 during the second and third frames FR2 and FR3 during which the data voltage corresponding to the second frame image data FD2 is applied to the display panel 100.

Since the absolute value of the cumulative polarity right after the third frame FR3 is less than 5, the first polarity signal POL1' transitions from the high state to the low state in synchronization with a time point at which the fourth frame image data FD4 are applied. The polarity of the data voltage corresponding to the second frame image data FD2 may be different from the polarity of the data voltage corresponding to the fourth frame image data FD4. The absolute value of the cumulative polarity right after the third frame is equal to or greater than 5. The second frame image data group FDG2 including the fourth frame image date output right after the third frame FR3 include two consecutive copy image data, e.g., the fourth and fifth frame image data FD4 and FD5. The cumulative polarity increases due to the polarity inversion when the data voltage corresponding to the fourth frame image data FD4 that are the first copy image data. Accordingly, the film image data RFBF include the fifth frame image data FD5 corresponding to next copy image data right after the fourth frame image data FD4.

The first polarity signal POL1' transitions from the low state to the high state in synchronization with a time point at which the fifth frame image data FD5 are applied. The first polarity signal POL1' is maintained in the high state until the seventh frame image data FD7 are input. The absolute value of the cumulative polarity is reduced to 3 during the fifth and sixth frames FR5 and FR6, during which the data voltage corresponding to fifth frame image data FD5 is applied to display panel 100.

Since the absolute value of the cumulative polarity right after the sixth frame FR6 is less than 5, the first polarity signal POL1' transitions from the high state to the low state in synchronization with a time point at which the seventh frame image data FD7 are applied. The polarity of the data voltage corresponding to the fifth frame image data FD5 may be different from the polarity of the data voltage corresponding to the seventh frame image data FD7. The first polarity signal POL1' is maintained in the low state from a time point at which the seventh frame image data FD7 are applied to a time point at which the ninth frame image data FD9 are input. The absolute value of the cumulative polarity increases to 5 during the seventh and eighth frames FR7 to FR8 during which the data voltage corresponding to the seventh frame image data FD7 is applied to the display panel 100.

The absolute value of the cumulative polarity right after the eighth frame FR8 is equal to or greater than 5, but the cumulative polarity is reduced due to the polarity inversion of the data voltage corresponding to the ninth frame image data FD9. Accordingly, the first polarity signal POL1' transitions from the low state to the high state at a time point at which the ninth frame image data FD9 are applied. The polarity of the data voltage corresponding to the seventh frame image data FD7 may be different from the polarity of the data voltage corresponding to the ninth frame image data FD9. The first polarity signal POL1' is maintained in the high state from a time point at which the ninth frame image data FD9 are input. The absolute value of the cumulative polarity is reduced to 3 during the ninth and tenth frames FR9 to FR10 during which the data voltage corresponding to the ninth frame image data FD9 is applied to the display panel 100.

According to the present exemplary embodiment, the polarity imbalance may be prevented from increasing more than the predetermined value when the display apparatus is operated in the film mode.

Figure 15:
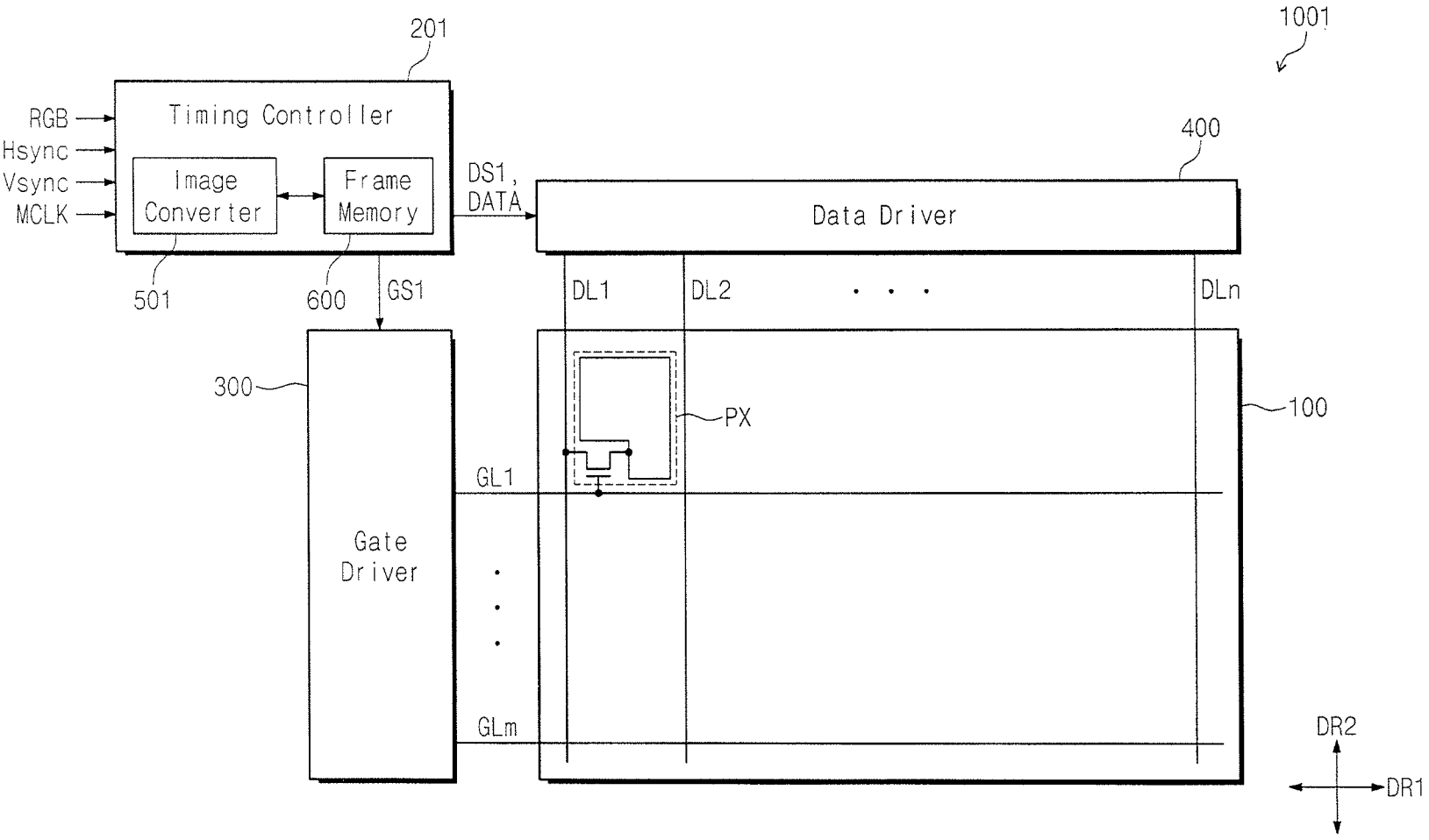
FIG. 15 illustrates another embodiment of a display apparatus.

FIG. 15 illustrates another embodiment of a display apparatus 1001, which may have the same structure and function as the display apparatus 1000 in FIG. 1 except for a timing controller 201.

The timing controller 201 includes an image converter 501 and a frame memory 600. The image converter 501 determines an operation mode based on the input image data RGB and applies input image data DATA converted in accordance with the operation mode to the data driver 400. Signals input to the timing controller 201 may be substantially the same as those input to timing controller 200 in FIG. 1. The frame memory 600 stores the input image data RGB in the unit of frame.

Figure 16:
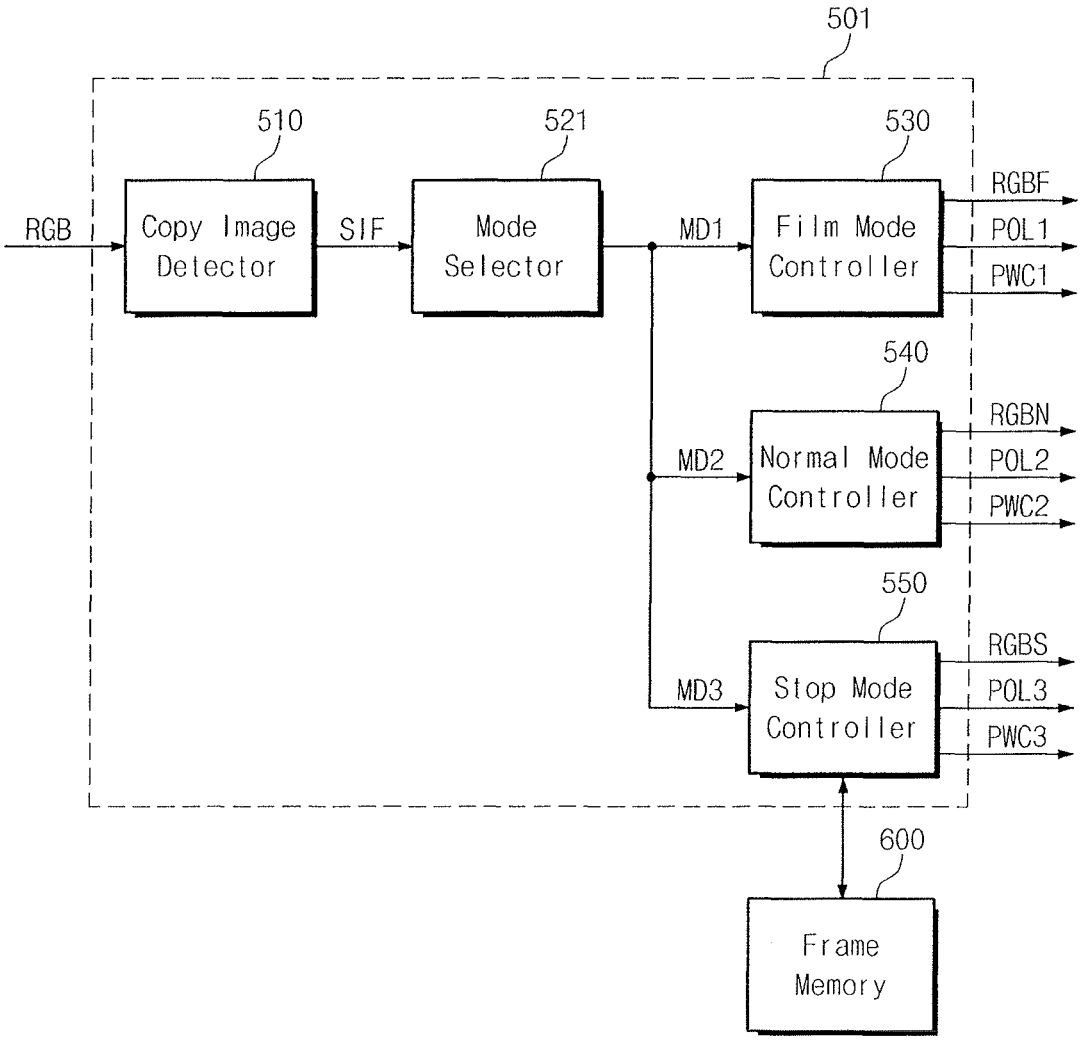
FIG. 16 illustrates an embodiment of an image converter and a frame memory.

FIG. 16 illustrates an embodiment of the image converter 501 and the frame memory 600 in FIG. 15. Referring to FIG. 16, the image converter 501 includes a copy image detector 510, a mode selector 521, a film mode controller 530, a normal mode controller 540, and a stop mode controller 550. The copy image detector 510, the film mode controller 530, and the normal mode controller 540 are substantially the same as in FIG. 4.

The mode selector 521 receives an image flag signal SIF and selects one of a film mode, a normal mode, and a stop mode. The mode selector 521 outputs a film mode signal MD1 when the mode selector 521 selects the film mode, outputs a normal mode signal MD2 when the mode selector 521 selects the normal mode, and outputs a stop mode signal MD3 when the mode selector 521 selects the stop mode.

The mode selector 521 determines which signal among the film mode signal MD1, the normal mode signal MD2, and the stop mode signal MD3 is output based on the interval of the frame in which the update image data among the input image data RGB are input. For example, when update image data are input every frame in a range between two and N inclusive, the mode selector 521 outputs the film mode signal MD1. When update image data are input every one frame, the mode selector 521 outputs the normal mode signal MD2. When the update image data are not input during M or more frames, the mode selector 521 outputs the stop mode signal MD3. (Here, N is a natural number equal to or greater than K, and M is a natural number greater than N).

When the input image data RGB are moving images, the mode selector 521 outputs film mode signal MD1 or normal mode signal MD2. When the input image data RGB are still images, the mode selector 521 outputs stop mode signal MD3.

When the stop mode controller 550 receives the stop mode signal MD3, the image converter 501 may be operated in the stop mode. The stop mode controller 550 receives the stop mode signal MD3 and outputs still image data RGBS, a third polarity signal POL3, and a third power control signal PWC3. The stop mode controller 550 stores frame image data of the input image data RGB in the frame memory 600 and reads out the stored frame image data from the frame memory 600 as the still image data RGBS.

Figure 17:
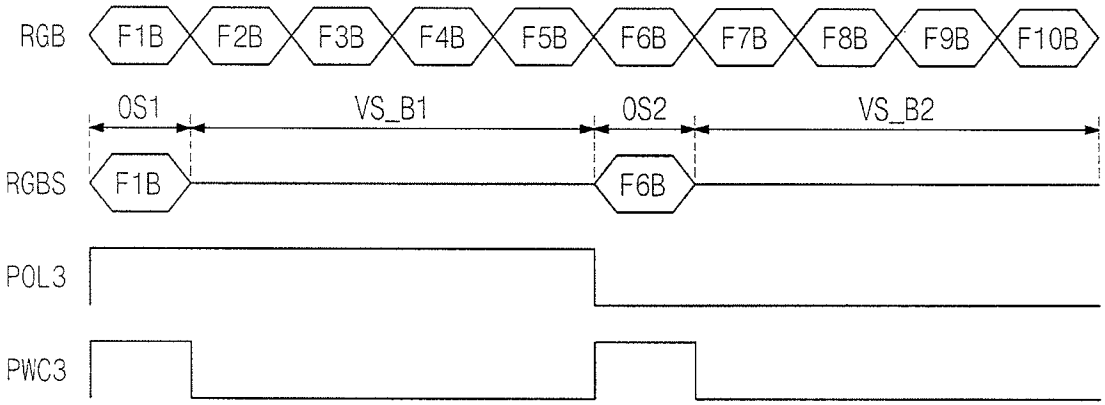
FIG. 17 illustrates an embodiment of input image data, still image data, a another polarity signal, and another power control signal.

FIG. 17 is a timing diagram illustrating an embodiment of the input image data RGB, the still image data RGBS, the third polarity signal POL3, and the third power control signal PWC3, which are input to or output from the stop mode controller MD3. In FIG. 17, the frame image data FIB to F10B of the input image data RGB may have different information from each other.

Referring to FIGS. 16 and 17, the stop mode controller 550 outputs the still image data RGBS, the third polarity signal POL3, and the third power control signal PWC3 to the data driver 400. The still image data RGBS may be output at the number of frames per second of low level lower than the middle level of the film image data RGBF. In this example, the low level is 12, and the still image data RGBS are output at 12 fps.

The display panel 100 (e.g., refer to FIG. 15) outputs an image corresponding to the still image data RGBS during the stop mode. The display panel 100 may be operated at a frequency with the low level.

During the stop mode, the data driver 400 (e.g., refer to FIG. 15) inverts the polarity of the data voltage in response to the third polarity signal POL3. Responsive to the third polarity signal POL3, the data driver 400 may invert the polarity of the data voltage whenever the frame image data of the still image data RGBS are output during the stop mode.

During the stop mode, the data driver 400 (e.g., refer to FIG. 15) controls the standby power in response to the third power control signal PWC3. For example, the data driver 400 receives the power during a high period of the third power control signal PWC3 and does not receive the power during a low period of the third power control signal PWC3.

The first frame image data F1B and the sixth frame image data F6B are output during first and second output periods OS1 and OS2, respectively.

A vertical blank period may be defined between the output periods of the frame image data of the still image data RGBS. As shown in FIG. 17, a first vertical blank period VS_B1 is between the first and second output periods OS1 and OS2 and a second vertical blank period VS_B2 is after the second output period OS2.

The third power control signal PWC3 is in a high state during the first and second output periods OS1 and OS2 and is in a low state during the first and second vertical blank periods VS_B1 and VS_B2.

The vertical blank period of the still image data RGBS is longer than the vertical blank period of the film image data RGBF. Accordingly, when the display panel 100 is operated in stop mode, power consumption may be less than that when the display panel 100 is operated in film mode due to control of the standby power of the data driver 400.

Figure 18:
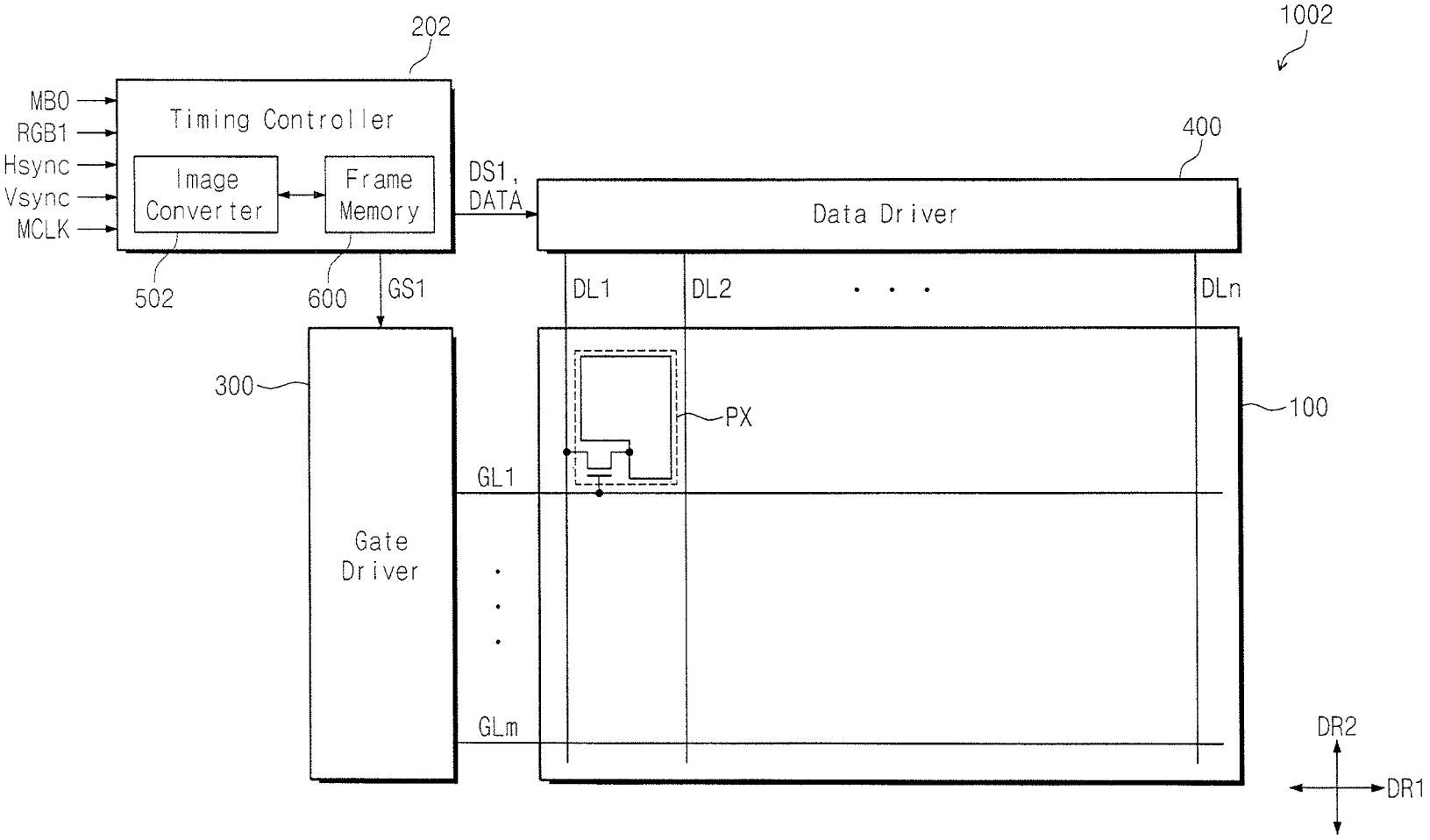
FIG. 18 illustrates another embodiment of a display apparatus.

FIG. 18 illustrates another embodiment of a display apparatus 1002, which has the same structure and function as the display apparatus 1001 in FIG. 15, except for a timing controller 202. The timing controller 202 receives input image data RGB1, an image information signal MBO, and control signals from an external graphic controller. The control signals may include, for example, a vertical synchronization signal Vsync as a frame distinction signal, a horizontal synchronization signal Hsync as a row distinction signal, and a main clock signal MCLK. The timing controller 202 includes an image converter 502 and a frame memory 600.

Figure 19:
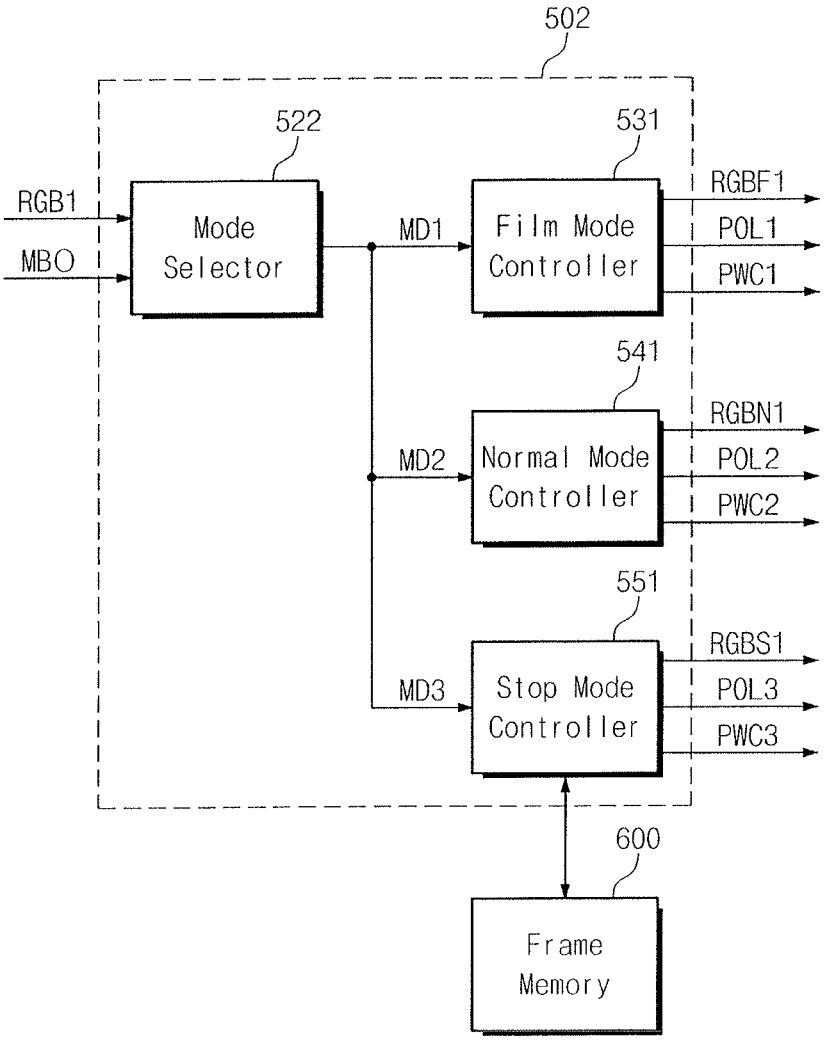
FIG. 19 illustrates another embodiment of an image converter and frame memory.

FIG. 19 illustrates an embodiment of the image converter 502 and the frame memory 600 in FIG. 18. Referring to FIG. 19, the image converter 502 includes a mode selector 522, a film mode controller 531, a normal mode controller 541, and a stop mode controller 551.

The input image data RGB1 may be still image data or moving image data. When the input image data RGB1 are moving image data, the input image data RGB1 include update image data and blank data. The update image data may be different from each other. Each of the update image data may correspond to the update image date described with reference to FIG. 5. The blank data may be between the update image data. The blank data are applied instead of the same data as the update image data applied right before the blank data. For example, the blank data may correspond to the copy image data described with reference to FIG. 5. The blank data may be black image data. In the present exemplary embodiment, since the blank data do not have information on the image, the blank data are not treated as valid data which are the subject of the calculation for the number of frames per second.

The image information signal MBO may have different states from each other during a period in which the update image data are applied and during a period in which the blank data are applied. As an example, the image information signal MBO is in a high state during the period in which the update image data are applied and is in a low state during the period in which the blank data are applied.

The mode selector 522 receives the image information signal MBO and input image data RGB1 and selects one of a film mode, a normal mode, or a stop mode. The mode selector 522 outputs a film mode signal MD1 when the mode selector 522 selects the film mode, outputs a normal mode signal MD2 when the mode selector 522 selects the normal mode, and outputs a stop mode signal MD3 when the mode selector 522 selects the stop mode.

The mode selector 522 determines which signal among the film mode signal MD1, the normal mode signal MD2, and the stop mode signal MD3 is output based on the number of the update image data, among the input image data RGB1 input during a specific time period. For example, when the number of the update image data among the input image data RGB1 input during the specific time period is in a range between F and G inclusive, the mode selector 522 outputs the film mode signal MD1. When the number of the update image data among the input image data RGB1 input during the specific time period exceeds G, the mode selector 522 outputs the normal mode signal MD2. When the number of the update image data among the input image data RGB1 input during the specific time period is less than F, the mode selector 522 outputs the stop mode signal MD3. (Here, F is a natural number and G is a natural number equal to or greater than F). In the present exemplary embodiment, F may be 2, and G may be 3, but F and/or G may have different values in other embodiments.

When the input image data RGB1 are the moving images, the mode selector 522 outputs the film mode signal MD1 or the normal mode signal MD2. When the input image data RGB1 are the still images, the mode selector 522 outputs the stop mode signal MD3.

The film mode controller 531 receives the film mode signal MD1 and outputs film image data RGBF1, a first polarity signal POL1, and a first power control signal PWC1.

The normal mode controller 541 receives the normal mode signal MD2 and outputs normal image data RGBN1, a second polarity signal POL2, and a second power control signal PWC2.

The stop mode controller 551 receives the stop mode signal MD3 and outputs still image data RGBS1, a third polarity signal POL3, and a third power control signal PWC3.

The normal mode controller 541 and the stop mode controller 551 may be substantially the same as the normal mode controller 540 and the stop mode controller 550 described with reference to FIGS. 15 and 16.

Figure 20:
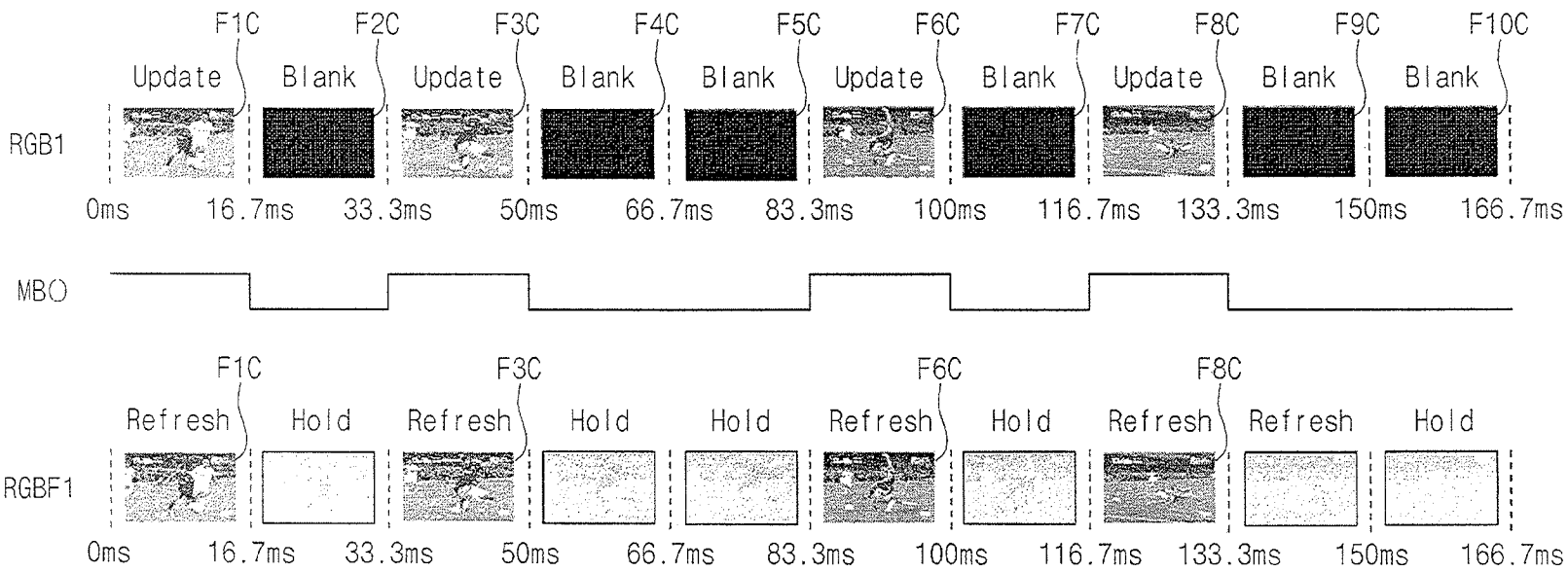
FIG. 20 illustrates another embodiment of input image data input to or output from a film mode controller and film image data generated based on an image information signal.

FIG. 20 illustrates and embodiment of input image data input to or output from the film mode controller and the film image data RGBF generated based on the image information signal MBO.

Referring to FIGS. 19 and 20, the input image data RGB1 may be input at the number of frames per second of middle level. The middle level may be, for example, 24. Thus, the update image data of the input image data RGB1 may be applied twenty-four times per second, e.g., 24 fps.

The input image data RGB1 in FIG. 20 include ten consecutive frame image data F1C to F10C. First frame image data F1C, third frame image data F3C, sixth frame image data F6C, and eighth frame image data F8C may be update image data different from each other. Second frame image data F2C, fourth frame image data F4C, fifth frame image data F5C, seventh frame image data F7C, ninth frame image data F9C, and tenth frame image data F10C may be blank data and black image data.

The input image data RGB1 in FIG. 20 include the update image data input every two or three consecutive frames. Thus, the mode selector 522 may output the film mode signal MD1 when the input image data RGB1 in FIG. 20 are input.

The film mode controller 531 may output the update image data of the input image data RGB1 as the film image data RGBF1 based on the image information signal MBO. The film mode controller 531 may generate the film image data RGB1 from the input image data RGB1 based on the image information signal MBO without storing the input image data RGB1 into the frame memory 600. The film image data RGBF1 may be output at the number of frames per second of the middle level. In FIG. 20, the middle level is, for example, 24. Thus, the update image data of the film image data RGBF1 may be output twenty-four times per second.

The display panel 100 displays an image corresponding to the film image data RGBF1 during the film mode. The display panel 100 may be operated at a frequency at the middle level. For instance, during a first frame (0 to 16.7 ms) set based on 60 Hz, the display panel 100 is refreshed to display an image corresponding to the first frame image data F1C. The image corresponding to the first frame image data F1C is maintained during a second frame (16.7 ms to 33.3 ms).

During a third frame (33.3 ms to 50 ms), the display panel 100 is refreshed to display an image corresponding to the third frame image data F3C. The image corresponding to the third frame image data F3C is maintained during fourth and fifth frames (50 ms to 83.3 ms).

During a sixth frame (83.3 ms to 100 ms), the display panel 100 is refreshed to display an image corresponding to the sixth frame image data F6C. The image corresponding to the sixth frame image data F6C is maintained during a seventh frame (100 ms to 116.7 ms).

During an eighth frame (116.7 ms to 133.3 ms), the display panel 100 is refreshed to display an image corresponding to the eighth frame image data F8C. The image corresponding to the eighth frame image data F8C is maintained during ninth and tenth frames (133.3 ms to 166.7.3 ms).

The display panel 100 is refreshed four times during ten frames set based on 60 Hz, and thus the display panel 100 may be understood to be operated at about 24 Hz.

The first polarity signal POL1 and the first power control signal PWC1 output from the film mode controller 531 may be the same as described with reference to FIGS. 7 and 9.

Figure 21:
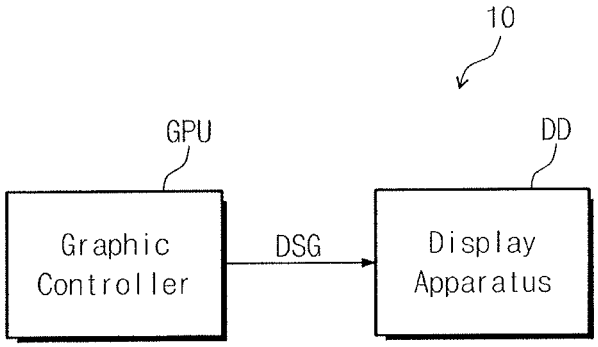
FIG. 21 illustrates an embodiment of an image display system.

FIG. 21 illustrates an embodiment of an image display system 10 which includes a display apparatus DD and a graphic controller GPU. The image display system 10 may be a portable terminal such as but not limited to a tablet PC, a smart phone, a personal digital assistant (PDA), a portable multimedia player (PMP), a game unit, or a wrist-type electronic device. The image display system 10 may be applied to a large-sized electronic item such as but not limited to a television set or an outdoor billboard, or to a small or medium-sized electronic device such as but not limited to a personal computer, a notebook computer, a car navigation unit, a camera.

The graphic controller GPU applies an image signal DSG to the display apparatus DD. The display apparatus DD may be one of the display apparatuses 1000, 1001, and 1002 described with reference to FIGS. 1 to 20.

When the display apparatus DD is one of the display apparatuses 1000 and 1001 described with reference to FIGS. 1 to 17, the image signal DSG may include the input image data RGB that includes the update image data and the copy image data obtained by copying the update image data.

When the display apparatus DD corresponds to the display apparatus 1002 described with reference to FIGS. 18 to 20, the image signal DSG may include the input image data RGB1 which includes the update image data and the blank data and the image information signal MBO.

Figure 22:
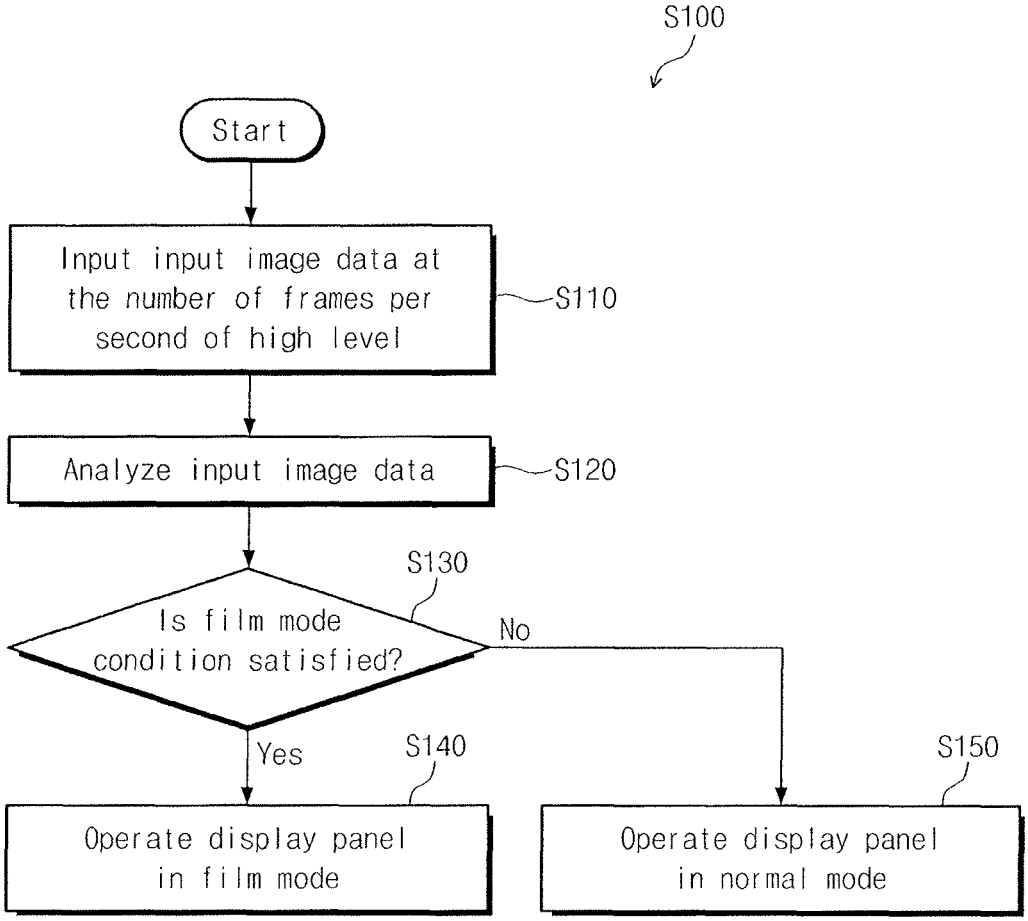
FIG. 22 illustrates an embodiment of a method for driving a display apparatus.

FIG. 22 illustrates an embodiment of a method S100 for driving a display apparatus. The driving method S100 of the display apparatus 1000 will be described as an example with reference to FIGS. 1 to 9 and 22.

The input image data RGB are input to the timing controller 200 at the number of frames per second of high level (S110). The timing controller 200 analyzes the input image data RGB in the unit of frame to determine whether the input image data RGB are the update image data or the copy image data (S120).

A determination is then made as to whether the input image data RGB satisfy the film mode condition (S130). In the present exemplary embodiment, the input image data RGB may be determined to satisfy the film mode condition when the update image of the input image data RGB is input every frame that is equal to or greater than K. The input image data RGB may be determined not to satisfy the film mode condition when the update image of the input image data RGB is input every frame less than K.

When the film mode condition is satisfied, the display panel 100 is operated in the film mode (S140). During the film mode, the display panel 100 may be operated at the frequency of a middle level lower than the high level. In the present exemplary embodiment, the high level is 60 and the middle level is 24.

When the film mode condition is not satisfied, the display panel 100 is operated in normal mode (S150). During normal mode, the display panel 100 may be operated at the frequency having the high level.

Figure 23:
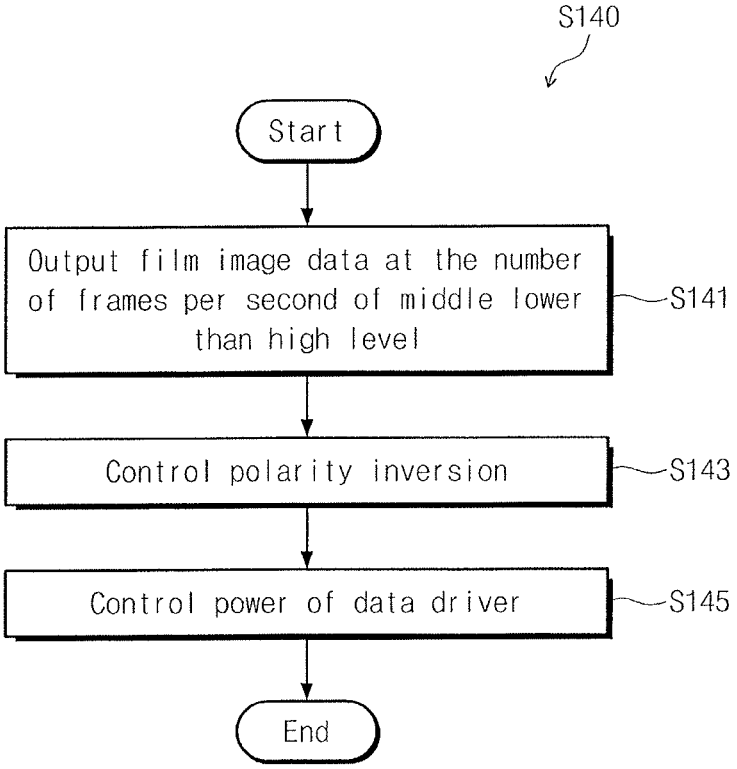
FIG. 23 illustrates an embodiment of operation in film mode.

FIG. 23 illustrates an embodiment of an operation in film mode, for example, corresponding to FIG. 2: Referring to FIGS. 1 to 9 and 23, the operation S140 may include operations S141, S143, and S145. The film image data RGBF may be output at the number of frames per second of the middle level lower than the high level (S141). The film image data RGBF may include the first copy image data right after the update image data.

The polarity of the data voltage corresponding to the frame image data in the film image data RGBF is inverted whenever the data voltage is output. The polarity of the data voltage may not be inverted in the case where the absolute value of the cumulative polarity is greater than the predetermined value and the cumulative polarity increases due to the polarity inversion (S143).

The power may not be supplied to the data driver during the blank periods between the output periods of the film image data (S145).

In FIG. 23, the operations S141, S143, and S145 are shown to be sequentially performed. In another embodiment, operations S141, S143, and S145 may be substantially simultaneously performed since each of the operations S141, S143, and S145 is performed during the film mode.

Figure 24:
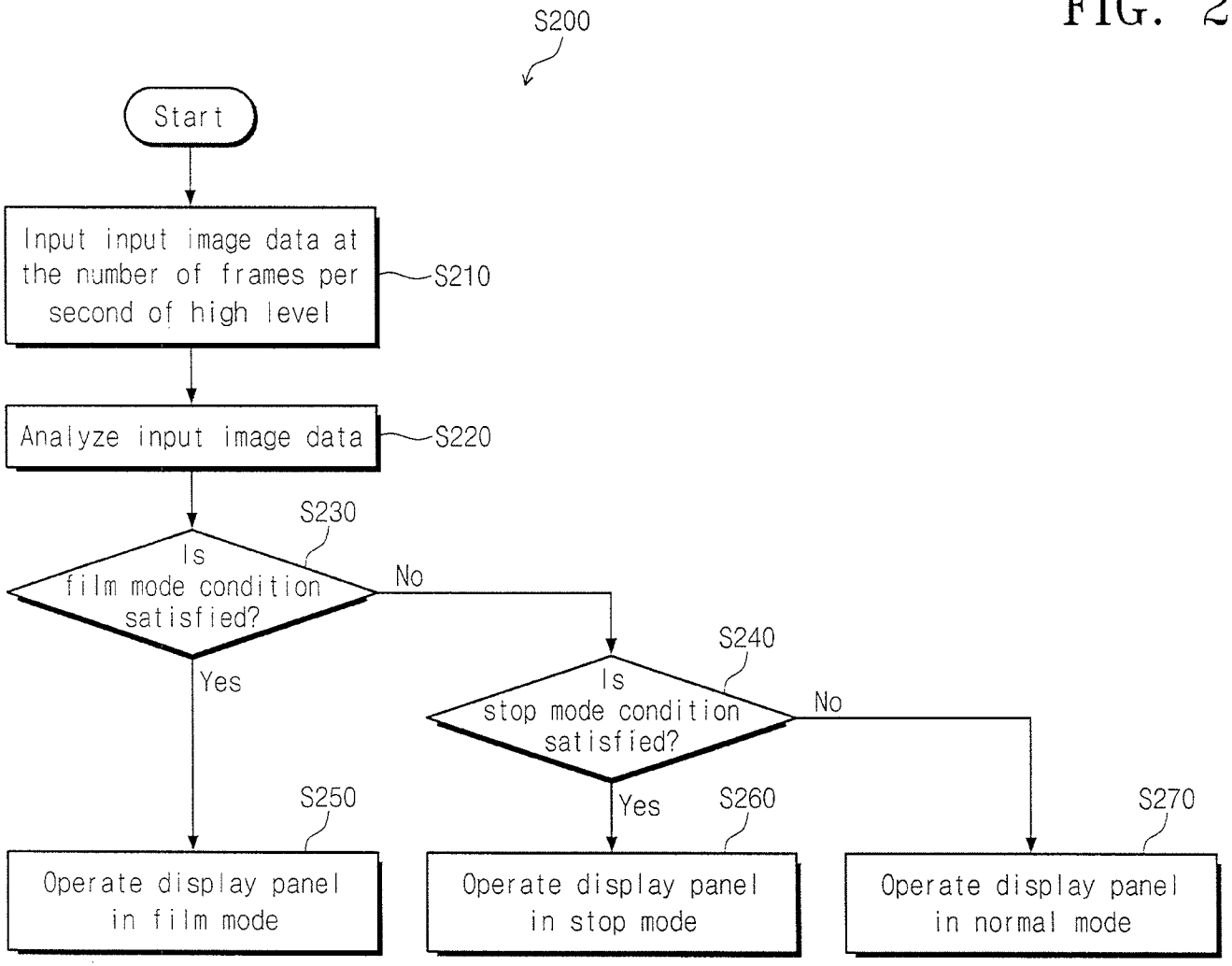
FIG. 24 illustrates another embodiment of a method for driving a display apparatus.

FIG. 24 illustrates another embodiment of a method S200 for driving a display apparatus. The driving method S200 of the display apparatus 1001 as an example will be described with reference to FIGS. 15 to 17 and 24.

The input image data RGB are input to the timing controller 201 at the number of frames per second of high level (S210). The timing controller 201 analyzes the input image data RGB in a unit of a frame to determine whether the input image data RGB are the update image data or the copy image data (S220).

A determination is made as to whether the input image data RGB satisfies the film mode condition (S230). In the present exemplary embodiment, the input image data RGB is determined to satisfy the film mode condition when the update image data of the input image data RGB are input every frame in a range between K and N inclusive. The input image data RGB is determined not to satisfy the film mode condition when the update image data of the input image data RGB are input every frame less than K or greater than N. (N may be a natural number, for example, equal to or greater than K).

When the film mode condition is satisfied, the display panel 100 is operated in the film mode (S250). During film mode, the display panel 100 may be operated at the frequency having the middle level lower than the high level. In the present exemplary embodiment, the high level is 60 and the middle level is 24.

When the film mode condition is not satisfied, a determination is made as to whether the input image data RGB satisfies the stop mode condition (S240). When the film mode condition is not satisfied, it is determined that the input image data RGB satisfy the stop mode condition when the update image data of the input image data RGB are not input during M or more frames. When the film mode condition is not satisfied, it is determined that the input image data RGB do not satisfy the stop mode condition when the update image data of the input image data RGB are input within M frames. M may be a natural number, for example, greater than N.

When the stop mode condition is satisfied, the display panel 100 is operated in the stop mode (S260). During stop mode, the display panel 100 may be operated at the frequency of the low level lower than the middle level. In the present exemplary embodiment, the frequency of the low level is about 12 Hz.

When the stop mode condition is not satisfied, the display panel 100 is operated in normal mode (S270). During normal mode, the display panel 100 may be operated at the frequency of the high level.

Figure 25:
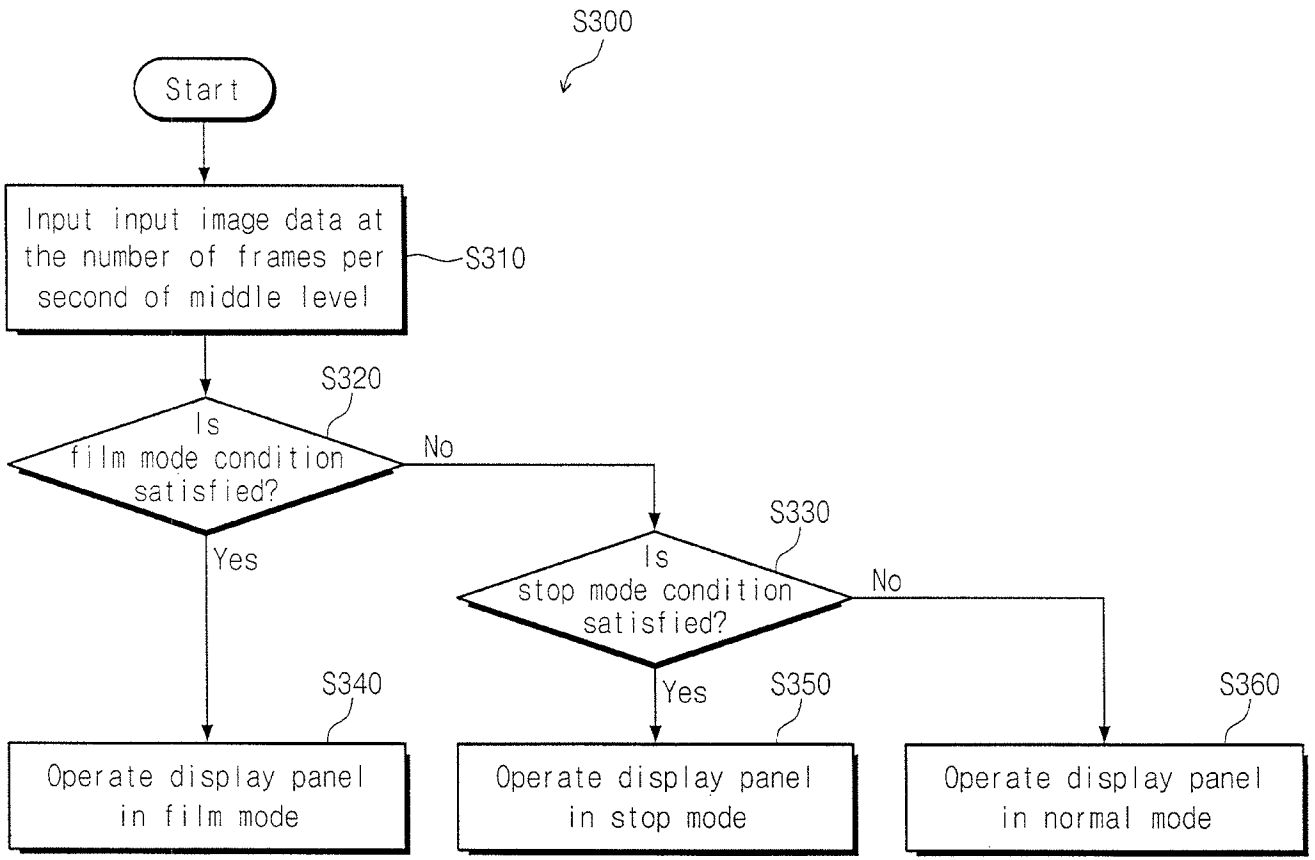
FIG. 25 illustrates another embodiment of a method for driving a display apparatus.

FIG. 25 illustrates another embodiment of a method S300 for driving a display apparatus. The driving method S300 of the display apparatus 1002 as an example will be described with reference to FIGS. 18 to 20 and 25.

The input image data RGB1 are input to the timing controller 202 at the number of frames per second of middle level (S310). The number of frames per second of middle level may be, for example, lower than about 60 fps. In this case, the image information signal MBO may be input to the timing controller 202.

A determination is made as to whether the input image data RGB1 satisfy the film mode condition (S320). In the present exemplary embodiment, it is determined that the input image data RGB1 satisfy the film mode condition when the number of the update image data of the input image data RGB1 input during the specific time period is in a range of between F and G inclusive. It is determined that the input image data RGB1 do not satisfy the film mode condition when the number of the update image data of the input image data RGB input during the specific time period is less than F or greater than G. (G may be a natural number, for example, equal to or greater than F).

When the film mode condition is satisfied, the display panel 100 is operated in film mode (S340). During film mode, the display panel 100 may be operated at the frequency having the middle level. In the present exemplary embodiment, the frequency having the middle level is about 24 Hz.

When the film mode condition is not satisfied, it is determined whether the input image data RGB1 satisfy the stop mode condition (S330). When the film mode condition is not satisfied, it is determined that the input image data RGB1 satisfy the stop mode condition when the number of the update image data of the input image data RGB1 input during the specific time period is less than F. When the film mode condition is not satisfied, it is determined that the input image data RGB1 do not satisfy the stop mode condition when the number of the update image data of the input image data RGB1 input during the specific time period exceeds G.

When the stop mode condition is satisfied, the display panel 100 is operated in the stop mode (S350). During stop mode, the display panel 100 may be operated at the frequency of the low level lower than the middle level.

When the stop mode condition is not satisfied, the display panel 100 is operated in normal mode (S360). During normal mode, the display panel 100 may be operated at the frequency of the high level. In the present exemplary embodiment, the high level may be about 60.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The controllers, converters, selectors, detectors, generator, compensator, and other processing features disclosed herein may be implemented in logic which, for example, may include hardware, software, or both. When implemented at least partially in hardware, the controllers, converters, selectors, detectors, generator, compensator, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, converters, selectors, detectors, generator, compensator, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Example embodiments have been disclosed herein, and although specific terms are employed, they are used and are to be interpreted in a generic and descriptive sense only and not for purpose of limitation. In some instances, as would be apparent to one of skill in the art, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the embodiments set forth in the claims.

What is claimed is:

1. A display apparatus, comprising:

a display panel to display images;

a timing controller to receive input image data at a number of frames per second of at least a middle level, the middle level being lower than 60 frames-per-second (fps) and to generate a gate control signal and a data control signal, the timing controller including an image converter to, when the received input image data is moving image data:

be operated in a film mode;

be operated in a normal mode; and output film image data at a number of frames per second of the middle level during the film mode;

a data driver to apply a data voltage corresponding to the film image data to the display panel based on the data control signal;

a gate driver to apply a gate voltage to the display panel based on the gate control signal, the display panel to be operated at a frequency of the middle level during the film mode; and a power controller to output a first power control signal to the data driver based on film image data such that the first power control signal is in a first state during output periods of the film image data, the first power control signal is in a second state during blank periods between the output periods of the film image data, the data driver is to receive power during the first state of the first power control signal, and the data driver is not to receive power during the second state of the first power control signal.

2. The display apparatus as claimed in claim 1, wherein:

the input image data includes update frames of image data different from each other and blank data between the update image data, and the timing controller is to select one of the film mode or the normal mode based on a number of the update image data input during a specific time period.

3. The display apparatus as claimed in claim 2, wherein the image converter includes:

a mode selector to receive the input image data, output a film mode signal when the number of the update image data input during the specific time period is in a range between F and G inclusive, output a normal mode signal when the number of the update image data input during the specific time period exceeds G, and output a stop mode signal when the number of the update image data input during the specific time period is less than F, where F is a natural number and G is a natural number greater than F;

a film mode controller to receive the film mode signal to output the film image data;

a normal mode controller to receive the normal mode signal to output the normal image data; and a stop mode controller to receive the stop mode signal to output still image data.

4. The display apparatus as claimed in claim 3, wherein:

the normal mode controller is to output the normal image data at a number of frames per second of a high level greater than the middle level, the stop mode controller is to output stop image data at a number of frames per second of low level less than the middle level, and the display panel is to be operated at a frequency of the high level during the normal mode and is to be operated at a frequency of the low level during the stop mode.

5. The display apparatus as claimed in claim 4, wherein:

the film image data includes the update image data, and the display panel is to be charged with the data voltage corresponding to one update image data during a plurality of frames set based on the frequency of the high level.

6. A method of driving a display apparatus, the method comprising:

inputting image data including update image data and blank image data to a timing controller at a number of frames per second of a middle level, the middle level being lower than a high level of 60 frames-per-second (fps);

operating a display panel in a film mode in which the display panel is operated at a frequency having the middle level when a number of the update image data of the image data input during a specific time period satisfies a film mode condition in which the number of the update image data is in a range of between F and G inclusive, where F is a natural number and G is a natural number greater than F; and controlling a first power control signal to a data driver that applies a data voltage to the display panel while in the film mode such that the first power control signal is in a first state during output periods of the film image data, the first power control signal is in a second state during blank periods between the output periods of the film image data, the data driver is to receive power during the first state of the first power control signal, and the data driver is not to receive power during the second state of the first power control signal.

7. The method as claimed in claim 6, further comprising:

operating the display panel in a stop mode in which the display panel is operated at a frequency having a low level lower than the middle level when the film mode condition is not satisfied and a stop mode condition in which the number of the update image data of the input image data is less than F is satisfied; and operating the display panel in a normal mode when the stop mode condition is not satisfied so that the display panel is operated at a frequency having the high level higher than the middle level.

8. A display apparatus, comprising:

a display panel to display images;

a timing controller to receive input image data at a number of frames per second of at least a middle level, the middle level being lower than 60 frames-per-second (fps) and to generate a gate control signal and a data control signal, the timing controller including an image converter to, when the received input image data is moving image data:

be operated in a film mode;

be operated in a normal mode; and output film image data at a number of frames per second of the middle level during the film mode; and a data driver to apply a data voltage corresponding to the film image data to the display panel based on the data control signal, wherein the data driver is to:

invert a polarity of the data voltage whenever the data voltage corresponding to the frame image data in the film image data is output based on the first polarity signal during the film mode, and when two or more copy image data in one frame image data group among the frame image data groups, input when an absolute value of a cumulative polarity is equal to or greater than a predetermined value, are consecutive and cumulative polarity increases due to a polarity inversion when the data voltage corresponding to the first copy image data is output, the film image data includes copy image data right after the first copy image data.

9. A display apparatus, comprising:

a display panel to display images;

a timing controller to receive input image data at a number of frames per second of at least a middle level, the middle level being lower than 60 frames-per-second (fps) and to generate a gate control signal and a data control signal, the timing controller including an image converter to, when the received input image data is moving image data:

be operated in a film mode;

be operated in a normal mode; and output film image data at a number of frames per second of the middle level during the film mode; and a data driver to apply a data voltage corresponding to the film image data to the display panel based on the data control signal, wherein the data driver is to:

invert a polarity of the data voltage whenever the data voltage corresponding to the frame image data in the film image data is output based on the first polarity signal during the film mode, and not to invert the polarity when an absolute value of a cumulative polarity is equal to or greater than a predetermined value and the cumulative polarity increases due to the polarity inversion.

* * * * *